US005870652A

United States Patent [19]

Kanamori et al.

[11] Patent Number: 5,870,652

[45] Date of Patent: Feb. 9, 1999

[54] DEVELOPER CARTRIDGE FEATURING A DEVELOPER REPLENISHMENT HOLE AND REMOVABLE CAP HAVING A GRIPPING MEMBER FOR SEALING THE HOLE AND A REMANUFACTURING METHOD USING THE SAME

[75] Inventors: Akihito Kanamori, Toride; Yutaka Ban, Tokyo; Kazuhiko Omata, Satte; Kazuyuki Miyano, Tokyo, all of Japan

[73] Assignee: Canon Kabushiki Kaisha, Tokyo, Japan

[21] Appl. No.: 365,127

[22] Filed: Dec. 28, 1994

[30] Foreign Application Priority Data

Dec. 28, 1993 [JP] Japan ..... 5-335535
Mar. 18, 1994 [JP] Japan ..... 6-048506

[51] Int. Cl.[6] ..... G03G 15/08

[52] U.S. Cl. ..... 399/106; 399/109

[58] Field of Search ..... 355/245, 260; 222/DIG. 1; 399/106, 109, 262

[56] References Cited

U.S. PATENT DOCUMENTS

| | | | |
|---|---|---|---|
| 4,949,123 | 8/1990 | Takashima | 355/260 |
| 4,981,218 | 1/1991 | Ban et al. | 206/633 |
| 5,030,997 | 7/1991 | Michlin et al. | 355/260 |
| 5,118,013 | 6/1992 | Mutou et al. | 222/171 |
| 5,235,389 | 8/1993 | Kikuchi et al. | 355/260 |
| 5,257,077 | 10/1993 | Peters, Jr. et al. | 355/260 |
| 5,268,722 | 12/1993 | Ikkatai et al. | 355/260 |
| 5,351,728 | 10/1994 | Ban et al. | 141/364 |
| 5,441,177 | 8/1995 | Yanagisawa | 222/167 |

FOREIGN PATENT DOCUMENTS

| | | |
|---|---|---|
| 62-86382 | 4/1987 | Japan . |
| 62-170987 | 7/1987 | Japan . |
| 63-62857 | 4/1988 | Japan . |
| 63-188665 | 12/1988 | Japan . |
| 3-131881 | 6/1991 | Japan . |
| 5-64803 | 3/1993 | Japan . |

*Primary Examiner*—William J. Royer
*Attorney, Agent, or Firm*—Fitzpatrick, Cella Harper & Scinto

[57] ABSTRACT

A developer cartridge comprising a cylindrical portion for accommodating a developer, being provided with a hole at a longitudinal end, wherein the developer is capable of being supplied into the cylindrical portion through the hole, a removable cap for capping the hole, and a gripping member for covering the cap and having a plate-like grip. A developing remanufacturing method, wherein the cartridge includes a cylindrical portion having an opening extending in a longitudinal direction, the cylindrical portion being provided with a hole at a longitudinal end, a cap for capping the hole and a gripping member, includes the steps of removing the gripping member, removing the cap, sealing the opening, supplying a developer through the hole, capping the hole, and mounting the gripping member.

11 Claims, 22 Drawing Sheets

DEVELOPER CARTRIDGE FEATURING A DEVELOPER REPLENISHMENT HOLE AND REMOVABLE CAP HAVING A GRIPPING MEMBER FOR SEALING THE HOLE AND A REMANUFACTURING METHOD USING THE SAME

FIELD OF THE INVENTION AND RELATED ART

The present invention relates to a developer cartridge for supplying a developer to a developing apparatus for an image forming apparatus such as a copying machine or printer and a remanufacturing method therefor.

In an image forming apparatus such as an electrophotographic copying machine or a laser beam printer, a photosensitive drum uniformly charged is exposed to a selective light to form a latent image thereon, and the latent image is developed with a developer into a visualized image, and the visualized image is transferred onto a transfer material. In such an apparatus, the developer is required to be supplied each time it is used up. A toner cartridge for supplying the developer into the developing apparatus is classified into a so-called replenishing type wherein all the developer therein is once supplied into a developer receptor in the main assembly of the image forming apparatus, and a so-called installation type wherein the cartridge is installed in the image forming apparatus after it is mounted therein, and the developer therein is supplied out gradually into the developing apparatus until the developer therein is used up.

Because of the recent demand for downsizing of the apparatus, the installing type cartridge is preferred. Particularly, a type becomes widely used wherein the cartridge is in the form of a cylinder having a developer supplying longitudinal opening in the form of a slit, and the cartridge is rotated to direct the opening horizontally rather than downwardly, and the developer is scooped up, as disclosed in Japanese Laid-open Patent Applications Nos. 86382/1987, 170987/1987 and Japanese Laid-open Utility Model Applications Nos. 62857/1988 and 188665/1988, for example.

The reason for using such an arrangement is that the latitudes of the toner cartridge location and the developing apparatus location are increased from the standpoint of downsizing and from the standpoint of supplying required and sufficient amount of the developer into the developing apparatus to maintain a constant amount of the developer in the developing apparatus, and from the standpoint of maintaining the constant toner/carrier ratio in the case of using a two component developer.

In such an image forming apparatus, a crank-shaped stainless steel is used to stir and feed the toner in the toner cartridge, or a stirring blade as shown in FIG. 17 is rotatably mounted in the toner cartridge to feed out the toner, as disclosed in Japanese Laid-open Patent Application No. 131881/1991.

In the conventional toner cartridge, a grip for mounting and demounting the toner cartridge relative to a developing apparatus is mounted at a front part, in a longitudinal direction, of a cylinder. Therefore, the grip is in the form of a cylinder with the result that the operator has to use the entire hand, not only some fingers. In the limited space in the main assembly of the apparatus, the operator's hand may be contacted to a part in the main assembly. Therefore, the operativity is not so good.

If the grip is changed to plate like form from the cylindrical shape in an attempt to improve the operativity in the mounting and demounting operations, the filling opening for the developer becomes very small because of the permitted space, and the filling efficiency and the filling rate are decreased.

A filling opening in a front flange is capped with a cap for closing the filling opening after the filling. The cap is exposed, and therefore, it is easily removed without intention by erroneous handling by the operator or during transportation.

SUMMARY OF THE INVENTION

Accordingly, it is a principal object of the present invention to provide a developer cartridge having an improved operativity upon mounting and demounting thereof.

It is another object of the present invention to provide a developer cartridge wherein a cap for the filling opening is not easily removed.

It is a further object of the present invention to provide a remanufacturing method for a developer cartridge by which parts can be efficiently used.

According to an aspect of the present invention, there is provided a developer cartridge, comprising: a cylindrical portion for accommodating a developer, said cylindrical portion being provided with a hole at a longitudinal end; a cap for capping the hole; and a grip for covering said cap and having a plate-like grip.

According to another aspect of the present invention, there is provided a developer cartridge remanufacturing method, wherein said cartridge comprises a cylindrical portion having an opening extending in a longitudinal direction, said cylindrical portion being provided with a hole at a longitudinal end, a cap for capping said hole and a grip, comprising the steps of: removing the grip; removing the cap; sealing the opening; supplying a developer through the hole; capping the hole; and mounting the grip.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the preferred embodiment of the present invention will be described.

Figure 1:
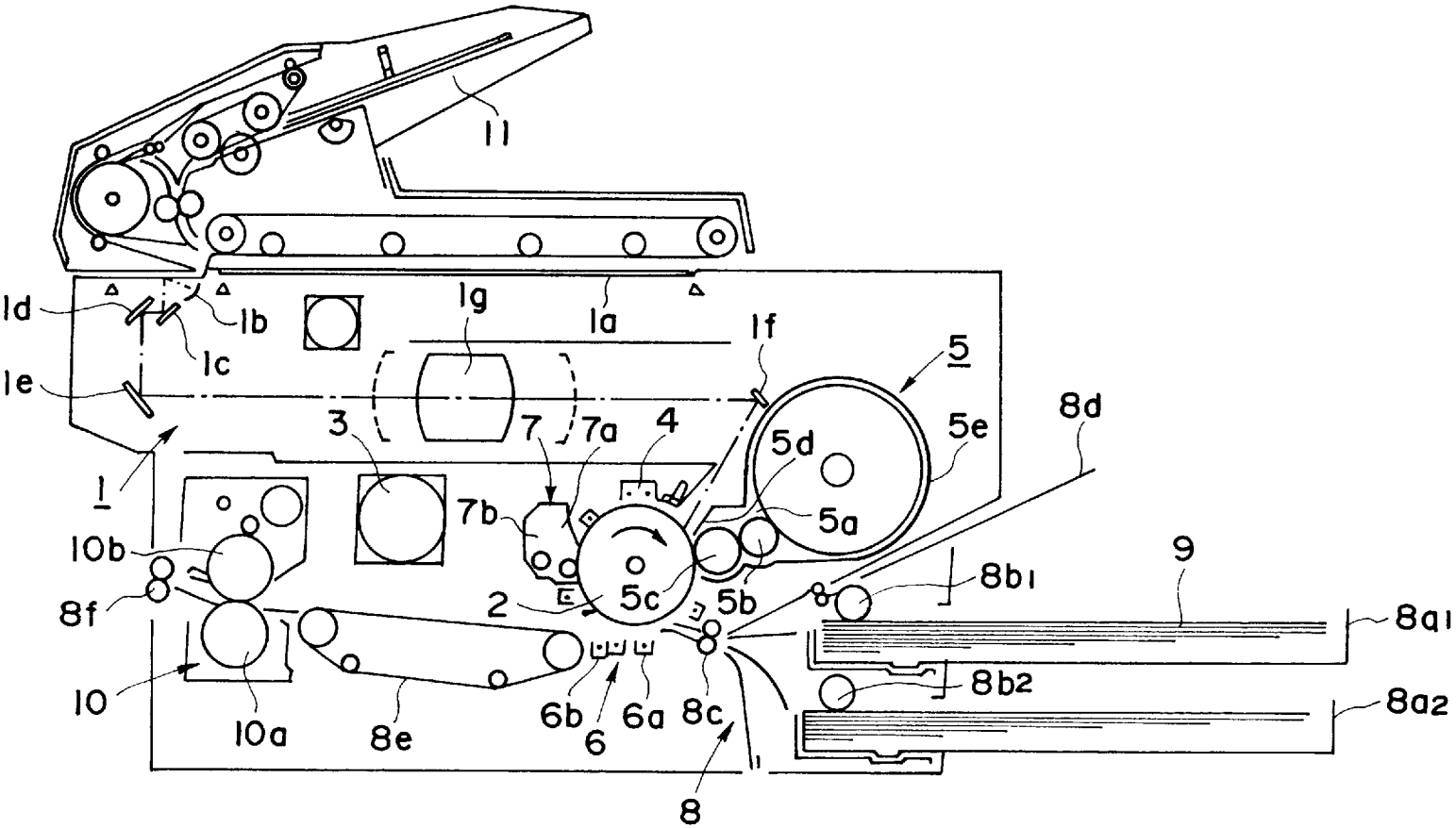
FIG. 1 shows a general arrangement of a copying machine.
Figure 2:
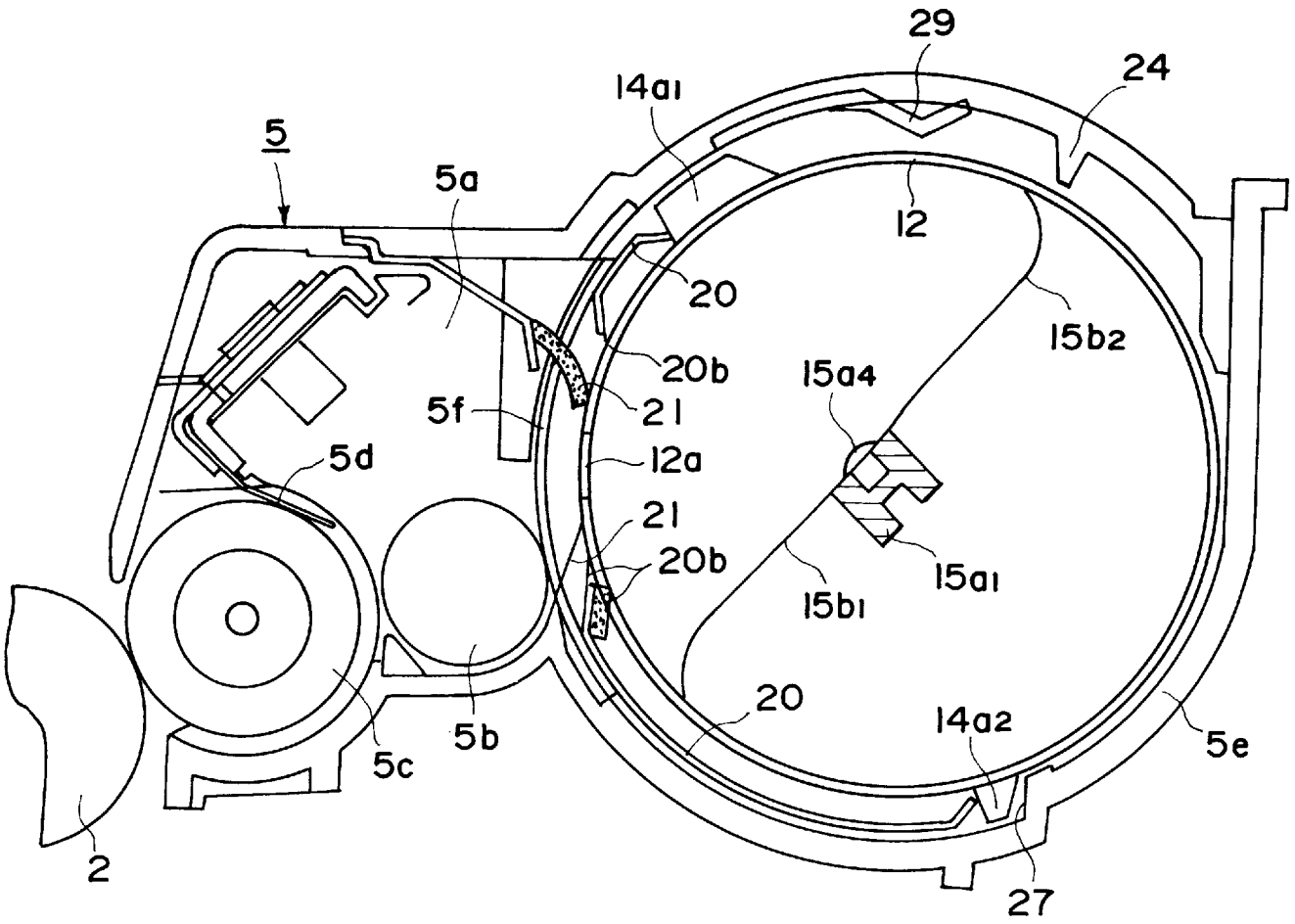
FIG. 2 is a sectional view of a developing apparatus.

FIG. 1 shows an electrophotographic copying machine as an exemplary image forming apparatus using the developer cartridge and developing apparatus according to an embodiment of the present invention, and FIG. 2 shows a developing apparatus on which a developer cartridge is mounted.

In FIG. 1, the image forming apparatus comprises an image reader 1 having an original supporting platen glass 1*a*, which is illuminated by an illumination lamp 1*b*. The original is scanned by the lamp 1*b* and scanning mirror 1*c*. The light reflected by the original is projected onto a photosensitive drum 2 through the mirror 1*c*, reflection mirrors 1*d*, 1*e* and 1*f*, and a focusing lens 1*g* having a magnification changing function.

The photosensitive drum 2 has a surface photosensitive layer, and is rotated by a main motor 3 in a direction indicated by an arrow in FIG. 1 during image forming operation. Around the photosensitive drum 2, there are a charging device 4, a developing device 5, transfer device 6, and a cleaning device 7. The surface of the rotating photosensitive drum 2 is uniformly charged by the charger 4, and the photosensitive drum 2 is exposed to the light image from the reader 1 so that an electrostatic latent image is formed on the photosensitive drum 2. The latent image is developed by the developing device 5 by transferring a developer, which will hereinafter be called "toner", to the electrostatic latent image.

The developing device 5 supplies the toner to a developing sleeve 5*c* containing therein a fixed magnet by a developer blade 5*b* from a developer chamber 5*a*. The developing sleeve 5*c* is rotated so that a layer of the toner is formed on the surface of the developing sleeve 5*c* while turboelectric charge is applied to the toner, by a developer blade 5*b*. The toner is transferred to the photosensitive drum 2 in accordance with the electrostatic latent image, thus visualizing the latent image into a toner image.

The toner image is transferred onto a recording material 9 fed by a sheet feeder 8 with a transfer voltage applied to the transfer device 6. The transfer device 6 has a transfer charger 6*a* and a separation charger 6*b*. By application of a voltage of a polarity opposite from that of the toner by the transfer charger 6*a*, the toner image is transferred onto the recording material 9. After the transfer, a voltage is applied to the recording material 9 by the separation charger 6*b* to separate the recording material 9 from the photosensitive drum 2.

After the image transfer, the toner remaining on photosensitive drum 2 is removed by a cleaning blade 7*a*, and the removed toner is collected into a collected toner container 7*b*, in the cleaning device 7.

On the other hand, sheet feeder 8 has a top and bottom cassettes 8*a*1 and 8*a*2 at a bottom part of the main assembly of the apparatus. The recording material contained in these cassettes are fed out one by one by a pick-up roller 8*b*1 or 8*b*2 to a pair of registration rollers 8*c*. Additionally, there is provided a manual feeder 8*d*. The recording material 9 fed out of the cassette or the manual feeder is fed to the registration rollers 8*c*, and receives the toner image from the photosensitive drum 2.

The recording material 9 after the transfer is fed to an image fixing device 10 by a conveyer belt 8, the fixing device comprising a driving roller 10*a* and a heating and pressing roller 10*b* containing therein a heater. The transferred image is fixed by application of heat and pressure by the fixing device 10. Then, the recording material 9 is discharged to the outside of the apparatus by a pair of discharging rollers 8*f*.

The copying machine of this embodiment, has an automatic document feeder 11 above the original supporting platen 1*a*, so that originals are automatically fed one by one. As with the document feeder any known types are usable.

(Toner Cartridge)

Figure 3:
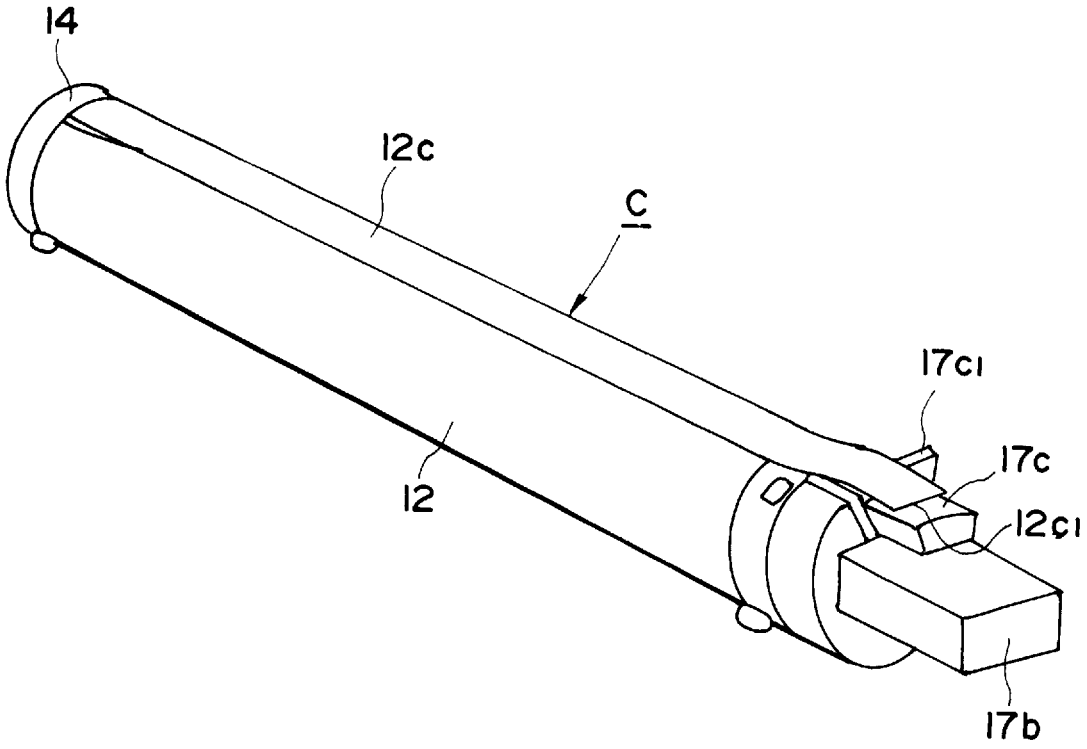
FIG. 3 is a perspective view of a toner cartridge.

The description will be made as to a toner cartridge C. As shown in FIGS. 2 and 3, the toner cartridge C is mountable to a cartridge mount 5*e* of the developing device 5, and is kept there. It gradually supplies the toner into developer chamber 5*a* (installing or built-in type).

Figure 4:
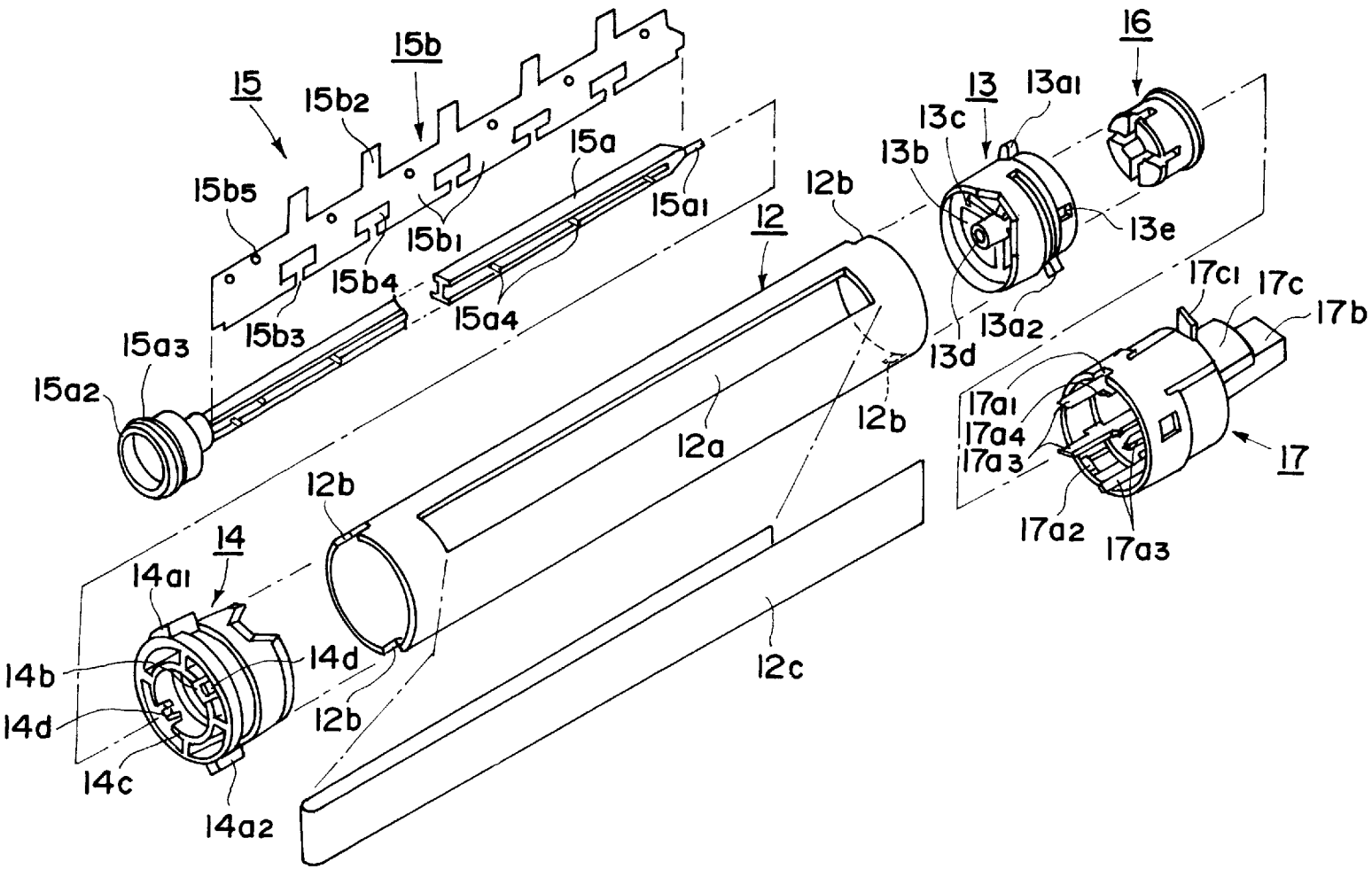
FIG. 4 is an exploded view of a part of a toner cartridge.

The toner cartridge C comprises, as shown in FIG. 4, a toner replenishing container 12, a flange 13, a flange 14, a stirring member 15, a cap 16, and a grip 17. Each part will be described in detail. Sealing structure of the stirring member will also described.

(Toner Replenishing Container 12)

As shown in FIG. 4, it is generally cylindrical (here, "cylindrical" is not limited to one having a circular cross-section but covers a polygonal cross-section). It is provided with a toner discharge opening 12*a* extending in a longitudinal direction thereof and a cut-away portion 12*b* at each of the opposite longitudinal ends for engagement with a projection of a flange 13 or flange 14 for the purposes of positioning.

The inner length of the toner replenishing container 12 is preferably approx. 160–400 mm, further preferably approx. 180–330 mm, even further preferably, approx. 200–310 mm.

If it is smaller than 160 mm, the toner supplied into the 5*a* does not extend throughout the length of a the developing sleeve 5*c*, with the result of tendency of drop-out of toner in a resultant image. If it is larger than 400 mm, the length of the developing device 5 is too large to downsize. The size is determined in accordance with the size of the sheets usable with the apparatus (A3, A4, B4).

The inner radius of toner replenishing container 12 is preferably approx. 10–50 mm, and further preferably approx. 15–35 mm, and even further preferably approx. 25–30 mm.

If it is smaller than 10 mm, the power of stirring member 15 (for particulation of caked toner and feeding of the toner into the developer chamber 5*a*) is not sufficient. If it is larger than 50 mm, the torque required by the stirring member 15 is too large.

In this embodiment, the toner replenishing container 12 has an inner radius of 55 mm, a wall thickness of 0.8 mm, inner length of the cylinder of 297.5 mm. The toner discharge opening 12*a* has a length of 296 mm which is generally equal to the length of the toner replenishing container 12, and a width of 7 mm.

In terms of the stirring member 15, the dimensional accuracy of the inner radius and the circularity is high. For this reason, the material of the toner replenishing container 12 is preferably thermoplastic resin material, among them ABS resin, polyester resin are preferable because they are easy to manufacture with high dimensional accuracy, because they are relatively less expensive and because they are strong against impact, such as falling. Next, anti-impact polystylene resin (HIPS) is preferable. Beside, these materials, paper or aluminum or the like is usable.

As a method of manufacturing the toner replenishing container 12 using thermoplastic resin material, it is preferable to form the toner discharge opening 12*a* and the cut-away portion 12*b* by pressing after extrusion. More preferably, inner sizing (cooling core type) is carried out to improve the inner diameter accuracy and circularity. Even further preferably, injection molding is used, since the accuracy is higher than the extrusion. Then, deformation due to hysteresis does not occur even if heat seal of the sealing film or hot melt fusing of the flange 13 and flange 14 are effected.

When the injection molding is used, it is preferable that one of the flanges is integrally molded with the cylindrical portion, as disclosed in Japanese Laid-open Patent Application No. 64803/1993, since then the number of parts and the manufacturing steps can be saved. In this case, the injection pressure of 500–1500 Kgf/cm$^2$, and the filing time of 0.005–0.02 sec are preferable.

The toner discharge opening 12*a* of the toner replenishing container 12 is sealed by a seal 12*c*1. The seal 12*c* is removed by an operator upon start of use of the toner cartridge C.

The seal 12*c* is in the form of a flexible film of laminations of polyester resin, Nylon, polyethylene resin, and ethylenevinylacetate. It has a thickness of approx. 50–200 microns, preferably 10–150 microns. The seal 12*c* is fixed to the toner replenishing container 12 with such a strength that the toner does not leak during transportation as the result of temperature change, pressure change, vibration, falling, impact or the like and that the peeling is permitted upon use. The peeling strength is preferably, not more than 10 kgf at the max., and preferably not more than 6 kgf, further preferably not more than 4.5 kgf, when the seal 12*c* is folded back at an angle of 180 degrees and pulled in a longitudinal direction.

As a method of fusing the seal 12*c* to the toner replenishing container 12, hot plate fusing, impulse sealing, ultrasonic wave fusing, high frequency fusing are preferable, and among them, hot plate fusing is most preferable.

The total length of the seal 12*c* is not less than twice the length of the toner discharge opening 12*a*. A part thereof not bonded to the toner replenishing container 12 is folded back at 180 degrees to provide a pulling portion, which is lightly fixed by a hot melt bonding agent, double sided adhesive tape or the like on a fixed portion of the seal 12*c*, toner replenishing container 12, flange 13 or grip 17.

The flange 13 and flange 14 are mounted to the respective ends of the cylindrical portion of the toner replenishing container 12, and they are manufactured through injection molding using ABS resin, polyester resin, HIPS or another thermoplastic resin material. The flange 13 and flange 14 each have two projections 13*a*1 and projection 13*a*2, projection 14*a*1 and projection 14*a*2. The projections are engaged with the cut-away portions 12*b* of toner replenishing container 12.

One of the flanges, i.e., flange 13 is provided with a filling opening 13*b* for permitting the toner to feed therethrough. Inside the filling opening 13*b*, a cross rib 13*c* is formed, and a bore 13*d* for receiving the stirring member 15 is formed at the center of the cross rib 13*c*. It is preferable that the diameter of the filling opening 13*b* is not less than 50% of the inside diameter of the toner replenishing container 12, further preferably not less than 60% from the standpoint of improving the filling period and filling efficiency.

Another flange, i.e., flange 14 is provided with a bore 14*b* for receiving stirring member 15, and around the bore 14*b*, there is a jaw 14*c* for supporting an outer periphery of a gear 15*a*2 of the stirring member 15. The jaw 14*c* is provided with a claw 14*d* for engagement with a ring rib 15*a*3 of the gear 15*a*2.

Flange 13 and flange 14 are engaged with the respective ends of the toner replenishing container 12 having the seal 12*c*. Engaging method may be with hot melt bonding, ultrasonic wave fusing, or adhesive tape. Particularly, hot melt is preferable because sufficient sealing and bonding strength can be provided without difficulty. Additionally, a method of applying a hot melt bonding material to an inner surface of the toner replenishing container 12 is preferable, since there is no liability of outside projection of the bonding material.

Heights of projection 13*a*1, projection 13*a*2, projection 14*a*1 and projection 14*a*2 of the flange 13 and flange 14 and a relation with the toner discharge opening 12*a* will be described hereinafter.

(Stirring Member 15)

Figure 5:
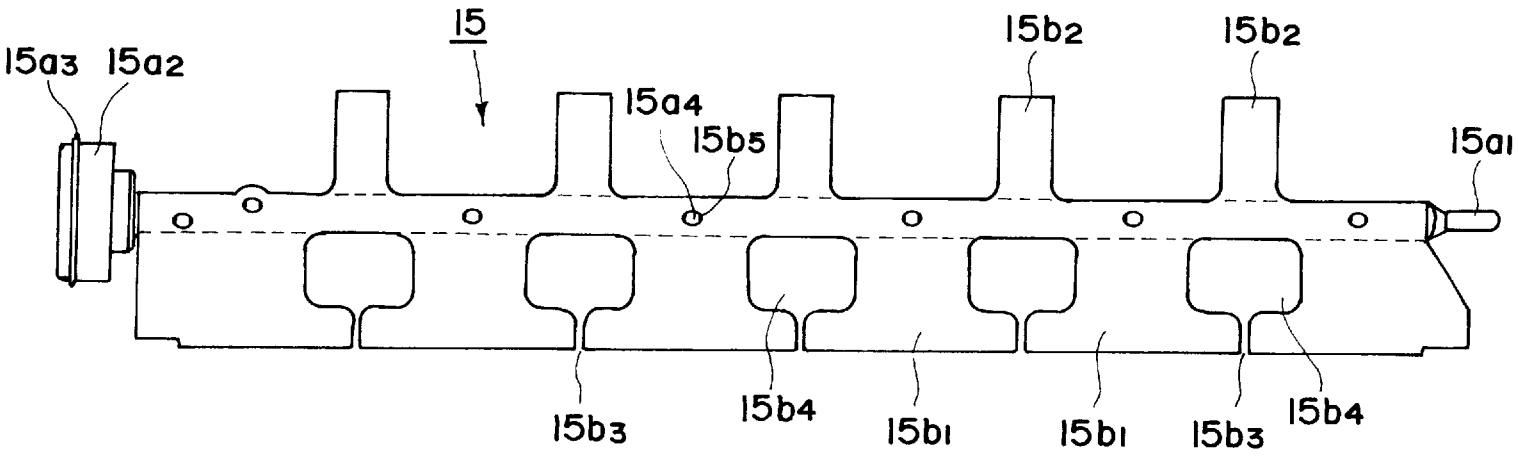
FIG. 5 illustrates a stirring member.

As shown in FIGS. 4 and 5, the stirring member 15 comprises a stirring shaft 15*a* and a stirring blade 15*b*.

(Stirring Shaft 15*a* )

The stirring shaft 15*a* is in the form of a rod having an "H" cross-section, for example. At one longitudinal end thereof, a portion 15*a*1 to be received by a bore 13*d* of the flange 13 is formed, and at the other end, the gear 15*a*2 is formed for connection with a driving system. The gear 15*a*2 has a ring rib 15*a*3 at the outer periphery. Press-fitting bosses 15*a*4 are formed for supporting stirring blade 15*b*.

It is important that the stirring shaft 15*a* has a sufficient straightness, and therefore, the stirring shaft 15*a* has a general shape of an "H", "L", "T" or the like to prevent bending, and particularly "H" is preferable.

The material of the stirring shaft 15*a* is preferably polyacetal (POM) in consideration of the sliding property at the bearing portions and the anti-creep. As the manufacturing method, injection molding is preferably used from the standpoint of easy manufacturing.

(Stirring Blade)

The stirring blade 15*b* to be mounted to the stirring shaft 15*a* is provided with a projection projected at least in two directions from the shaft 15*a*. In this embodiment, it comprises a major blade portion 15*b*1 and auxiliary blade portion 15b2 in two directions. The major blade portion 15b1 has an end portion over the entire length of the shaft 15a, and there are provided slits 15b3. In communication with the slits 15b3, there are provided rectangular holes 15b4. The auxiliary blade portion 15b2 has an end surface at a position corresponding to the slit 15b3.

At a longitudinally central portion of the blade 15b, a plurality of press-fitting bores 15b5 are provided to receive the boss 15a4 of the stirring shaft 15a.

As the material showing proper elasticity and proper anti-creep for the stirring blade 15b, for example, polyurethane rubber sheet, or cloth coated with rubber are preferable, and a particularly preferable material is a polyester (PET) film. It preferably has a thickness of approx. 50–500 μm, further particularly approx. 150–300 μm. If it is smaller than 50 μm, the elasticity is not enough with the result of lower toner feeding force. If it is larger than 500 μm, the elasticity is too strong with the result of required large torque to rotate the stirring blade 15b in contact with the inner surface of the container 12. In this embodiment, the thickness is approx. 188 μm.

As the manufacturing method for the stirring blade 15b, the above-described material is stamped out by pressing, since it is of high accuracy without high cost.

The stirring shaft and stirring blades 15b thus manufactured are integrated by inserting the boss 15a4 into the bore 15b5, press-fitting them by heat or ultrasonic wave. The stirring member 15 is inserted into the container 12, and the opposite ends thereof are supported by the flanges 13 and 14 to permit the rotation thereof. The method of mounting the stirring member 15 will be described hereinafter. The description will be made as to the shape of the stirring blade 15b. It is preferable that the stirring blade 15b projects from the stirring shaft 15a in at least two directions. Particularly, it is preferable as in this embodiment that the blade extending in the two directions has different lengths of tangent line with respect to the internal wall surface of the container 12. One of the main blade portion 15b1 is provided with a plurality of slits 15b3 but it is still extended over the entire length of the blade 15a, and therefore has a sufficient restoring force, and therefore, has a high toner feeding power. In addition, the slits 15b3 and the holes 15b4 are effective to prevent increase of the torque. The auxiliary blade portion 15b2 extended only at the portion corresponding to the slit 15b3 and the holes 15b4, are effective to reduce the remaining amount of the toner. By doing so, if the comparison is made with a blade portion extended uniformly in the two directions, the required torque is smaller in this embodiment despite the higher toner feeding force.

From the standpoint of reducing the required torque and increasing of the toner feeding force, the width of the slit 15b3 in the main portion of the blade 15b1 has a width of approx. 0.5–3 mm. The interval between the slits is preferably approx. 20–60 mm, further preferably approx. 30–55 mm, even further preferably approx. 34–52 mm.

The length of the rectangular hole 15b4 in the longitudinal direction is preferably approx. 20–80% of the interval of the slits. It is preferable that the side thereof which is parallel with the stirring shaft 15a and adjacent to the shaft 15a is in contact with the stirring shaft 15a.

From the standpoint of reducing the toner remaining amount and reducing the required torque, the length of the end surface of the auxiliary portion 15b2 measured along the length of the rotational shaft is preferably approx. 5–15 mm longer than the width of the slit 15b3.

The description will be made as to the distance of the stirring blades 15b1 and 15b2 in the radial direction. It is slightly longer than the internal radius of the container 12a, so that it is rotated with light contact with the inner wall of the container 12a. By doing so, the stirring blades 15b1 and 15b2 are rotated with small deformation, and when the deformation is removed by the elasticities of the blades 15b1 and 15b2 at the opening 12a, the toner is thrown, and as a result the toner supplying effect is increased.

Therefore, the distance from the rotational center of the stirring member 15 to the free end of the blade is longer by approx. 0.5–5 mm, preferably 1.0–4 mm, further preferably 1.5–3 mm approximately than the inner radius of the container 12.

If the difference is smaller than 0.5 mm, the sufficient restoration force of the blade is not expected, and if it is larger than 3 mm, the toner feeding power is too large with the result of excessive toner supplied into the developer chamber 5a, which may lead to caking of the toner. Additionally, the required rotational torque is large.

In this embodiment, as described hereinbefore, the stirring shaft 15a and the stirring blades 15b are separately manufactured, and are integrated by press-fitting. Preferably, however, the stirring shaft 15a and the stirring blade 15b may be integrally formed through ejection molding or the like. By doing so, the number of parts and manufacturing steps can be reduced, and in addition, the accuracy of the dimension from the center to the free end of the blade can be improved.

In this case, a high speed and high pressure injection molder is preferably used since then the thick wall portion of the shaft and the thin wall portion of the blade can be simultaneously molded with high precision. In this integral molding type, the ejection pressure is approx. 500–1500 $kgf/cm^2$, and the filling time of the resin material is preferably approx. 0.005–0.02 sec. Using these values, an integral stirring member 15 having the integral stirring shaft 15a and stirring blade 15b is injection-molded, and it has been found that any in conveniences such as waving or the like are not observed in the stirring blade 15b.

As a further preferable manufacturing method, there is a gas assist injection molder. In this case, the stirring shaft 15a can be a hollow shaft, which is convenient from the standpoint of the straightness of the stirring shaft 15a. The cross-section is preferably circular in which two parts are removed in the hollow part. The removed part is effective as a seat for the mounting of the stirring blade 15b.

(Cap)

The cap 16 functions to plug the filling opening 13b in the flange 13, after the toner is filled in the container 12. It is of low density polyethylene, high density polyethylene, polypropylene or the like (preferably low density polyethylene), and in the form of a cylinder having a bottom portion.

By press-fitting the cap 16 into the filling opening 13b, by which the filling opening 13b is closed and sealed so that the toner leakage is prevented.

(Grip)

Figure 6:
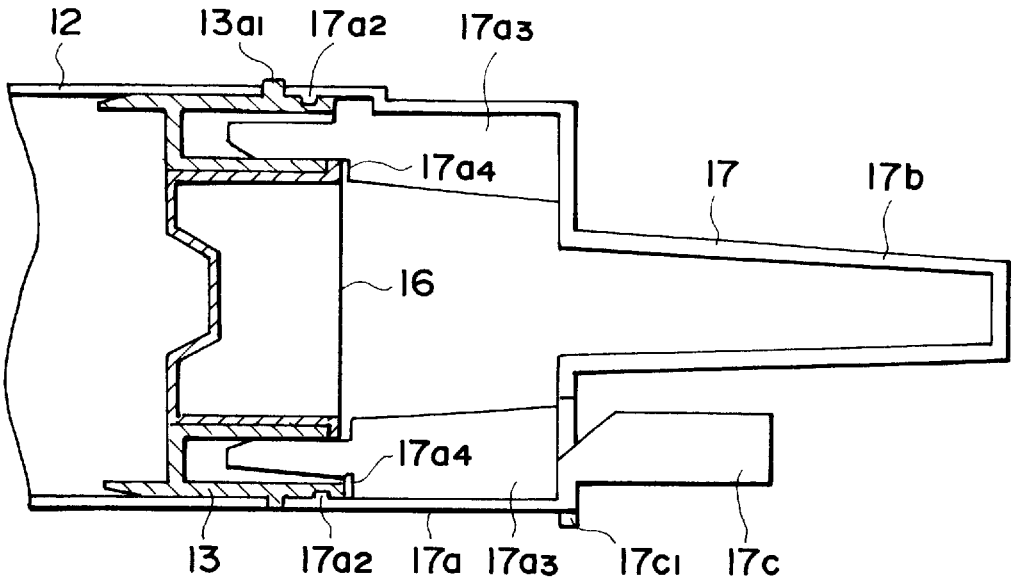
FIG. 6 is a sectional view of a part with a grip.

The description will be made as to the grip 17. It is effective to cover the cap 16 for the opening 13b after the filling of the toner into the container 12, and the cover may also function as a grip when mounting or demounting the toner cartridge C, relative to the developing device 5. As shown in FIGS. 4 and 6, it has an integral movable lever 17c constituting locking means for preventing rotation of the engaging portion 17a, grip 17b and the toner cartridge C. As the material for the grip 17, polypropylene (PP), acrylonitrile styrenebutadiene copolymer (ABS) or anti-impact polystyrene (HIPS) or another thermoplastic material are preferable. Polypropylene is further preferable since the movable lever 17*c* using elasticity is provided.

The engaging portion 17*a* functions to engage the grip 17 in the flange 13. It is in the form of a cylinder, and at an end thereof, a cut-away portion 17*a*1 is formed corresponding to the projection 13*a*1 or 13*a*2 of the flange 13. At several positions of the internal surface (equidistant three portions in this embodiment), engaging claws 17*a*2 are provided. By engaging the cut-away portion 17*a*1 with the projections 13*a*1 and 13*a*2, the positioning is accomplished. It is firmly locked into a recess 13*e* in the outer surface of the flange 13, by which the grip 17 is fixed to the flange 13.

The inside surface of the engaging portion 17*a* is provided with several ribs 17*a*3 (four ribs are preferable). The internal diameter between the end of the ribs is substantially equal to the outer diameter of the cap 16. When the grip 17 is engaged with the flange 13, the internal diameter portions of the ribs confine the outer peripheral surface of the cap 16. At a predetermined position of the rib 17*a*3, a stepped portion 17*a*4 is formed, at a position for confining an end of the cap 16 when the grip 17 is engaged with the flange 13, as shown in FIG. 6.

By doing so, when the grip 17 is engaged with the flange 13, the cap 16 is completely hidden, and in addition, it is confined by the rib 17*a*3, so that disengagement of the cap 16 from the opening 13*b* is completely avoided.

As a method of mounting the grip 17 to the flange 13, the above-described clamping method is not limiting, but hot melt bonding, ultrasonic wave fusing, press-fitting, adhesive tape or the like are usable. However, the above-described clamping method is preferable since it is easy. When this is used, disengageable structure is usable.

The movable lever 17*c* is vertically movable by the elasticity of the engaging portion 17*a* with a slit in the engaging portion 17*a*. At a predetermined position, a locking projection 17*c*1 is formed. The projection 17*c*1 is locked at a predetermined position of the developing device 5 when the toner cartridge C is mounted on the developing device 5 with the rotation, so that the rotation of the toner cartridge C is prevented during image forming operation.

(Toner Cartridge Manufacturing Method)

The description will be made as to the process of assembling the toner cartridge C, using the above-described members.

As described, the sheet 12*c* is mounted to the opening 12*a* of the container 12 to plug the opening 12*a*, and a hot melt bonding material is applied on the internal surface of the container 12 at the opposite end portions. The projections 13*a*1, 13*a*2, 14*a*1 and 14*a*2 of the flanges 13 and 14 are aligned with the cut-away portions 12*b* of the container 12. The flanges 13 and 14 are engaged and bonded at the opposite ends of the toner replenishing container 12.

Then, a stirring member 15 comprising the stirring shaft 15*a* and the stirring blades 15*b* mounted thereon is inserted into the bore 14*b* of the flange 14 to mount it to the container 12. Since the stirring blades 15*b* are flexible and thin, and since the length between the end of the main blade portion 15*b*1 and the auxiliary blade portion 15*b*2 is larger than the diameter of the bore 14*b*, the insertion is not easy.

Figure 7:
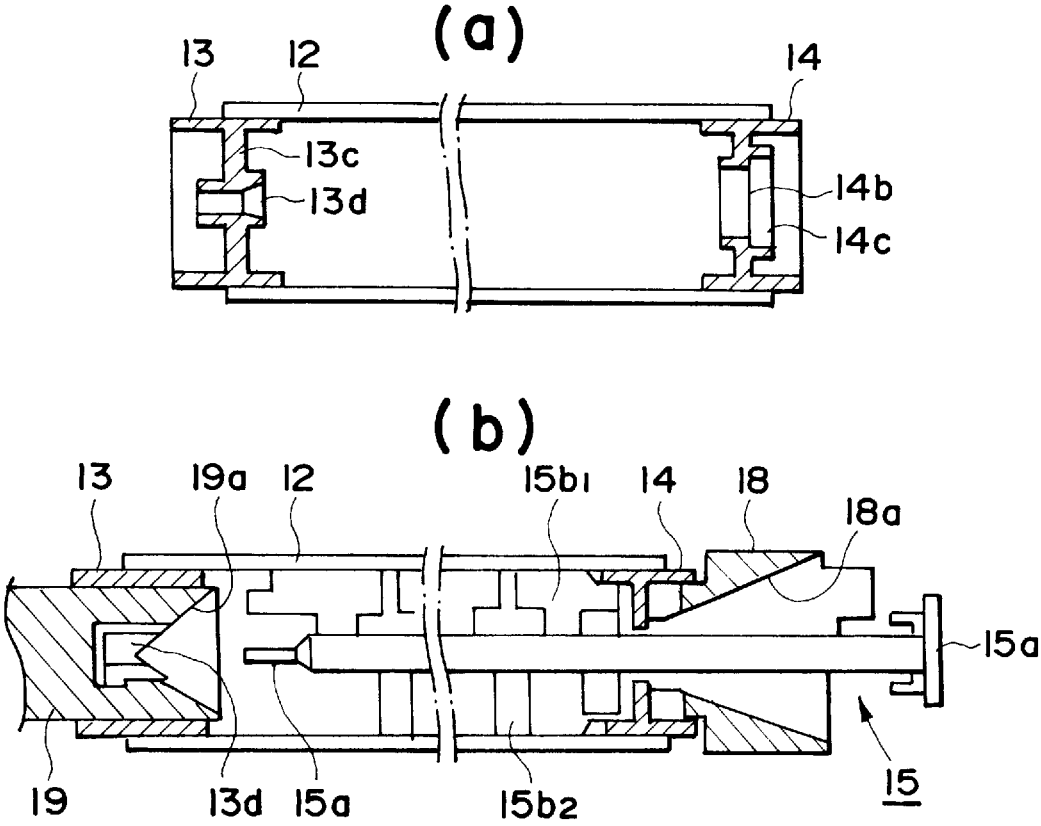
FIGS. 7A and 7B illustrate mounting of the stirring member to a toner replenishing container.

As shown in FIG. 7B, a tool 18 is mounted to the flange 14. The tool has a bore 18*a* in the form of a funnel having gradually and continuously decreasing diameter. The small diameter portion of the funnel bore 18*a* has the same size as the bore 14*b* of the flange 14. When the tool 18 is mounted to the flange 14, the small diameter portion and the bore 14*b* are continuous. Therefore, when the stirring member 51 is inserted into the funnel bore 18*a* of the tool 18, the blades 15*b*1 and 15*b*2 are deformed along the surface of the funnel bore 18*a*, and therefore, they are smoothly inserted into the bore 14*b* of the flange while being along the bore surface.

In this manner, the stirring member 15 is inserted into the container 12, and the engaging portion 15*a*1 at the end of the stirring member 15 is engaged into the shaft bore 13*d* of the flange 13. In order to make the insertion easy at this time, a tool 19 is mounted to the flange 13, as shown in FIG. 7B.

The tool 15 has a diameter permitting insertion into the filling opening 13*b* of the flange 13, and is provided with a cross groove (not shown) to avoid interference with the cloth rib 13*c* of the filling opening 13*b*. An end of the tool 19 is provided with a hole 19*a*, and has a larger diameter at the end. The diameter gradually decreases, and the smallest diameter portion is continuous with the hole 13*d*. Therefore, the engaging portion 15*a*1 of the end of the stirring member inserted from the flange 14 of the container 12 is guided by the funnel bore 19*a* and is smoothly brought into engagement with the shaft bore 13*d*.

After the engaging portion 15*a*1 is inserted into the shaft bore 13*d* as described above, the stirring member 15 is pushed strongly, by which the wing rib 15*a*3 of the gear 15*a*2 (FIG. 4) is engaged with the claw 14*d* of the flange 14 and clamping therebetween is established to prevent movement along the shaft. In addition, the outer periphery of the gear 15*a*2 is supported on the ring jaw 14*c* (FIG. 4) of the flange 14 to prevent movement in the radial direction. Therefore, the stirring member 15 is supported by the flanges 13 and 14 without play. Upon the mounting of the stirring member 15, a sealing member for preventing toner leakage is preferably mounted between them to prevent leakage of the toner between the bore 14*b* of the flange 14 and the gear portion 15*a*2 of the stirring member 15.

Figure 8:
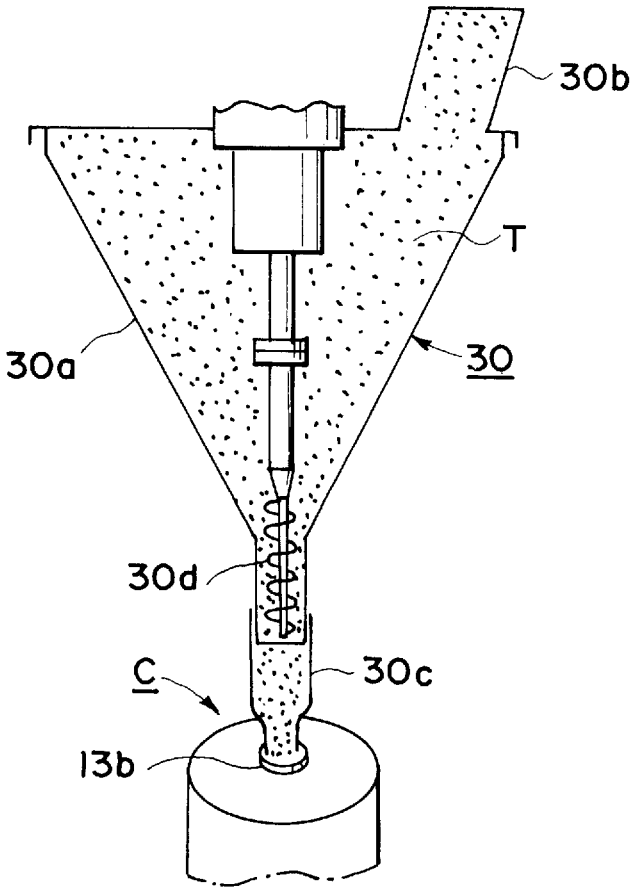
FIG. 8 illustrates toner filling.

Then, the tools 18 and 19 are removed. The toner is filled through the opening 13*b*. As shown in FIG. 8, the toner (one component magnetic toner in this embodiment) T is filled using developer hopper 30. The developer hopper 30 is provided with a supply port 30*b* for permitting supply of the toner T, at an upper portion of the funnel like main body 30*a*. At the bottom end, an adapter 30*c* for fitting with the port 13*b* of the toner cartridge C is mounted. Inside the main body 30*a*, there is an auger 30*d* which is rotatable. By properly controlling the rotation of the auger 30*d*, the toner filling speed can be controlled. The inside surface of the main body 30*a* is treated with fluorine to reduce the frictional coefficient, by which the toner filling efficiency from the developer hopper 30 to the toner cartridge C is improved. After the toner T is supplied in this manner, a gap 16 is press-fitted to the opening 13*b*, thus plugging the opening 13*b*.

Subsequently, the projections 13*a*1 and 13*a*2 of the flange 13 are aligned with the cut-away portion 17*a*1 of the grip 17, and the engaging portion 17*a* of the grip 17 is press-fitted into the flange 13, by which an engaging claw 17*a*2 of the engaging portion 17 is locked in a locking recess 13*e* of the flange 13 so that they are securedly clamped. By doing so, the cap 16 is completely hidden, and the cap 16 is fixed by the rib 17*a*3 (FIG. 6).

In the manner described above, the toner cartridge C shown in FIG. 3 is assembled.

(Sealing Structure for the Stirring Member)

Figure 9:
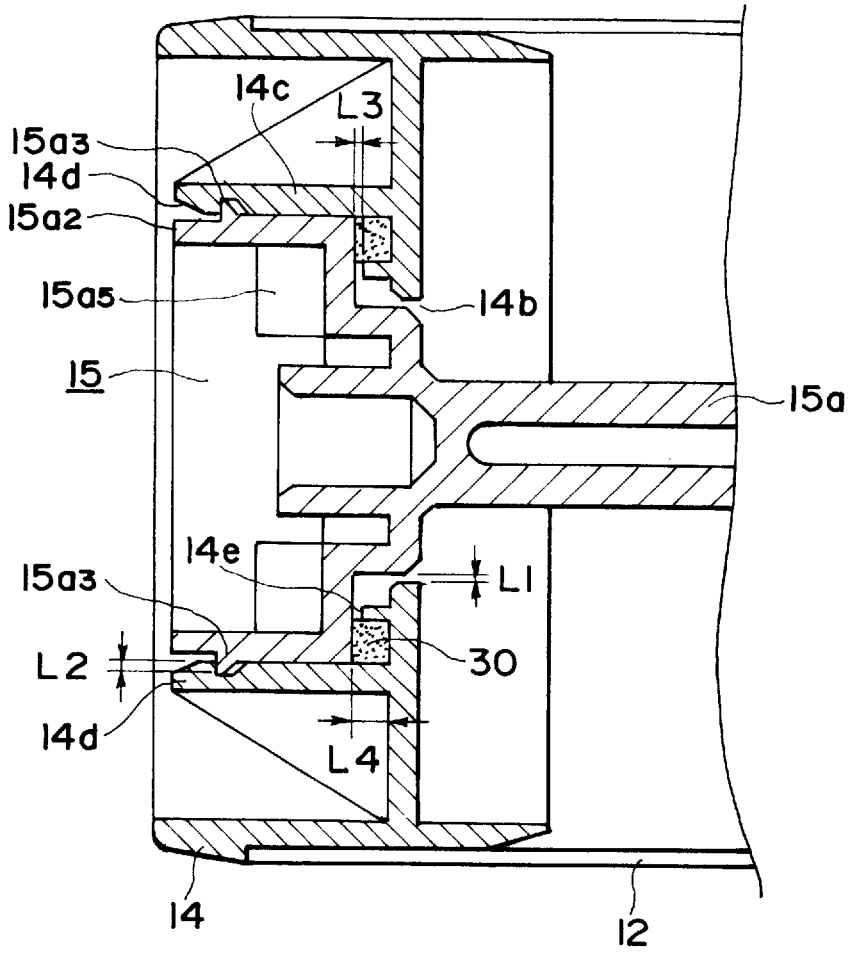
FIG. 9 is a sectional view of a seal between a gear of a stirring member and a flange.

Referring to FIG. 9, the description will be made as to the sealing structure for preventing toner leakage between a hole 14*b* of the flange 14 of the toner cartridge C and a gear 15*a*2 which is a drive transmission mechanism for transmitting the driving force to the stirring member 15.

As described hereinbefore, when the stirring member 15 is strongly pushed into the flange 14, the claw 14*d* which is an engaging portion on the flange 14 is engaged with a wing rib 15*a*3 which is a portion to be engaged and which is provided on the gear 15*b*2, so that the stirring member 15 is not movable in the longitudinal direction of the rotational shaft. Prior to the insertion of the stirring member 15, around the hole 14*b* of the flange 14, a gasket 30 in the form of a flat ring is provided as a toner leakage preventing seal. By doing so, the gasket 30 is sandwiched between the gear 15*a*2 and the flange 14, being compressed therebetween. As the material for the gasket 30, it is preferably elastic, and foamed polyetylene resin or polyurethane or the like, rubber sponge or wool felt or the like are usable. Particularly, the wool felt is particularly preferable because it has a proper elasticity, and has excellent durability with relatively good sliding property so that the required torque of the stirring member 15 can be lowered. In addition, it is less expensive. Therefore, in this embodiment, a wool felt having a thickness of 3.0 mm and an apparent density of 0.28 g/cm$^3$ is used. It is compressed to 2.5 mm between the gear 15*a*2 and the flange 14.

When the density of the gasket 30 is too high, it is difficult to provide the sealing property, and the required torque tends to increase. Therefore, when a high density gasket is used, the compression ratio is lowered to suppress the required rotational torque. The compression ratio is determined on the basis of the dimensions of the stirring member and the flange 14 and the thickness of the gasket 30. It is easy to increase or decrease the compression ratio. However, there is a variation in any case. The stirring member 15 and the flange 14 are manufactured by injection molding of the thermoplastic resin material, and therefore, there is a possibility that fine pits and projections are formed on the contact surface to the gasket 30. For this reason, if the density of the gasket 30 is too high, it becomes difficult to assure the sealing property by accommodating the pits and projections.

If the density of the gasket 30 is too low, it is difficult to maintain the sealing property for a long period of time, and in addition, in the case of the wool felt, it becomes easily fuzzy. Therefore, if the density of the gasket 30 is too low, the dimensional variation and the surface roughness can be easily accommodated, and therefore, the sealing property can be easily accomplished. However, when the compressed state lasts for a long term, a permanent compression deformation results, and therefore, the sealing property is rather insufficient.

As a result of the foregoing reasons, the gasket 30 is preferably wool felt, and preferably has an apparent density of 0.20 g–0.35 g/cm$^3$, further preferably 0.25–0.30 g/cm$^3$.

The compression ratio of the gasket 30 is a property determined in accordance with the material of the gasket 30 and the apparent density. In the case of the wool felt having the above-described apparent density, it is preferably 4–40%, further preferably 10–30% and even further preferably 15–20%. If the compression ratio is smaller than the range, the permanent deformation results from the long term compression so that the sealing property is lowered. If it is larger than the range on the contrary, the sealing property is lowered, and the required torque increases.

The flange 14 is provided with a ring rib 14*e* to which an inside diameter portion of the gasket 30 in the form of a flat ring is contacted. The rib 14*e* is provided for the following purposes.

That is, the rib 14*e* sandwiches the gasket 30 to prevent the gasket 30 from being rotated by the stirring member 15, and in addition, it is effective to prevent the fibers of the wool felt from entering the toner replenishing container 12. When the stirring blade 15*b* is inserted into the container 12, the gasket 30 is prevented from becoming fuzzy, and in addition, it is effective to guide the stirring blade 15 into the hole 14*b*. Additionally, when the process cartridge C is allowed to fall, the gear 15*a*2 is abutted to the rib 14*e* so that the stirring member 15 is prevented from entering the container 12, thus preventing release of the engaging portions. As shown in FIG. 9, a space 31 is formed between the rib 14*e* and the gear 15*a*2, and the space functions as a buffer for the toner particles stirred in the container 12. That is, when the toner particles receive shearing force, they escape to the space so that the shearing force is eased, thus preventing production of caked particles (coarse particles).

By sandwiching a gasket 30 between the flange of the container 12 and the gear 15*a*2 of the stirring member 15, the leakage of the toner between them can be assuredly prevented. By properly selecting the compression ratio of the gasket 30, an abnormal increase of the torque of the stirring member 15 can be prevented. Therefore, the rotational speed of the stirring member 15 can be increased, thus increasing the toner feeding power to increase the image formation speed.

In addition, the engaging portion between the flange 14 and the gear 15*a*2 (claw 14*d* and the ring rib 15*a*3) are outside of the gasket 30, and therefore, the leaked toner is prevented from reaching the engaging portions. Therefore, the production of coarse particles as a result of agglomeration by the friction between the engaging portion, can be prevented. Thus, white stripes and black dots resulting from the coarse particles, can be prevented beforehand.

The preferable dimensions of the parts shown in FIG. 9 will be described. An interval L1 between the hole 14*b* and the stirring member 15 is 0.3–3 mm, preferably 0.3–1.5 mm, and further preferably about 0.5 mm such that the stirring rod 15 is not contacted to the inside of the hole even if it is eccentric, and such that the hole diameter is minimized.

The engaging length L2 of the claw 14*d* is preferably 0.3–3 mm, further preferably 0.7–2 mm and even further preferably 1.2 mm such that the engaging is assured while the engagement is easy.

The gap L3 between the end of the rib 14*e* and the gear 15*a*2 is preferably 0.3–1 mm, further preferably 0.3–0.7 mm, and even further preferably about 0.5 mm such that the fibers of the gasket are prevented from entering the container 12 and such that the gear 15*a*2 is not rubbed with the rib 14*e*.

The thickness L4 of the compressed gasket 30 is preferably 1–5 mm, further preferably 2–3 mm and even further preferably 2.5 mm such that the sufficient sealing property is provided and such that the coarse toner particles are not produced.

The above-described dimensions are easily accomplished by properly selecting the dimension of the gasket 30 and the flange and the stirring member 15. Particularly in this embodiment, the gear 15*a*2 is integrally formed on the stirring shaft 15*a* of the stirring member 15, and therefore, the selection of the above-described dimensions is easy. As compared with the case of using separate members, the numbers of parts and manufacturing steps can be reduced.

(Mounting of the Toner Cartridge to a Developing Apparatus)

Figure 10:
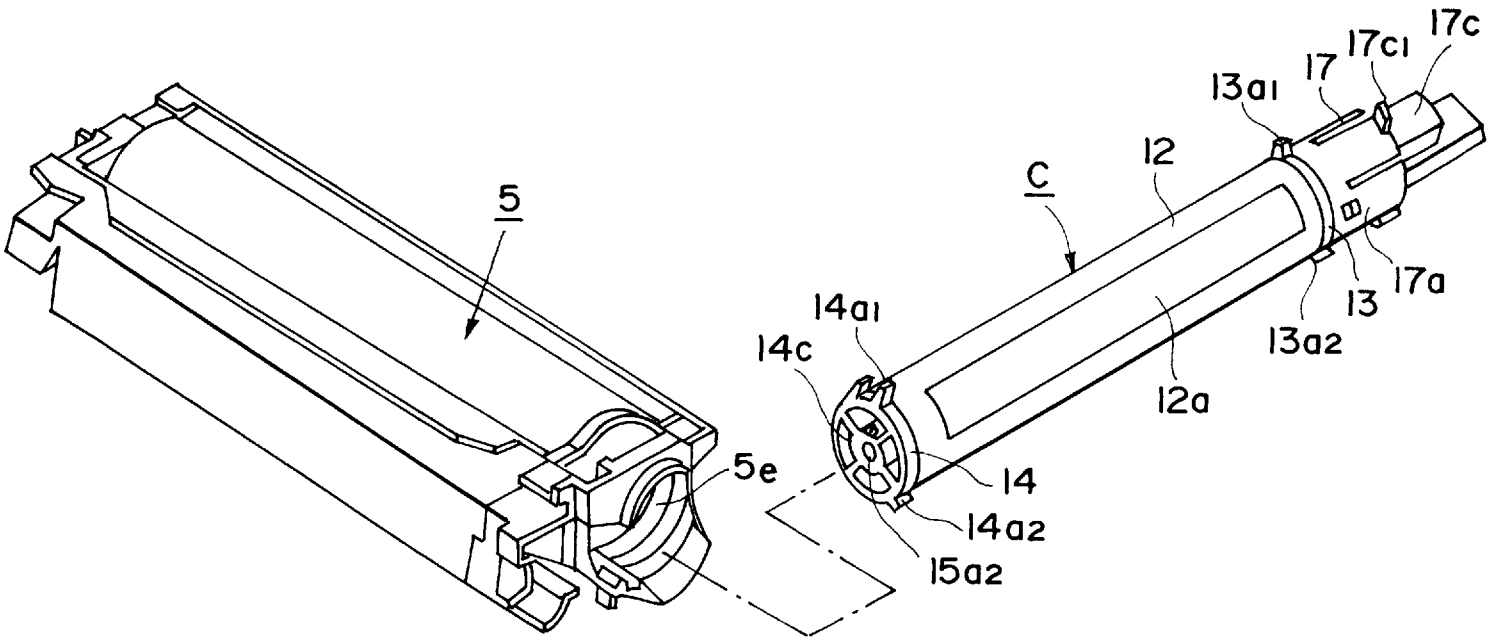
FIG. 10 is a perspective view of a toner cartridge and a developing apparatus.

The toner cartridge C is inserted into a cartridge mount 5*e* of the developing apparatus 5, as shown in FIG. 10. The developing device 5, as shown in FIG. 2, is provided with a cartridge mount 5*e* for receiving the toner cartridge C adjacent to the developer chamber 5*a*. The mount 5*e* and the developer chamber 5*a* are in communication with each other through an opening 5*f*. The communicating portion is provided with a shutter 20 for closing and shutting the opening 5*f*. The shutter 20 rotates with the mounting and demounting of the toner cartridge C.

The description will be made as to the structure of the shutter 20 and the mounting process of the toner cartridge.

(Shutter)

Figure 11A:
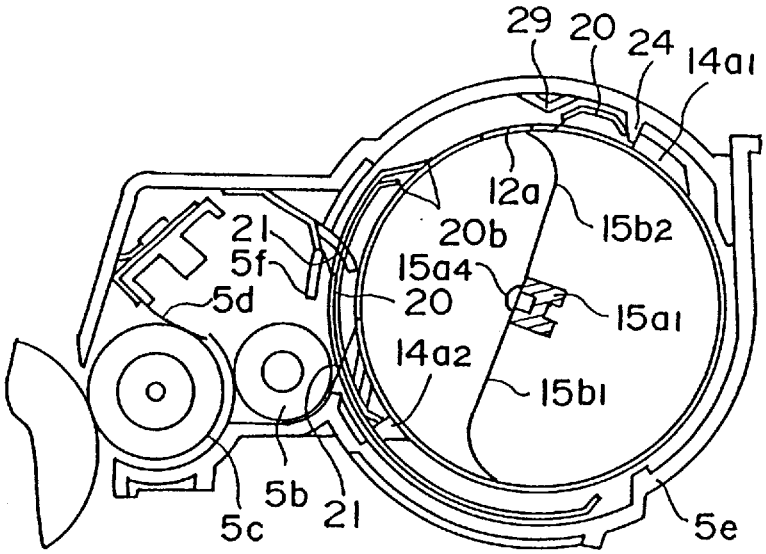
FIG. 11A illustrates a toner cartridge when it is inserted to a cartridge mount.

When the toner cartridge C is not mounted on the mount 5*e* or when the toner cartridge C shown in FIG. 11A is in a mounting or demounting position (pose) with the opening 12*a* at an upper position, the shutter member 20 closes the opening 5*f* to permit reverse flow of the toner from the developer chamber 5*a* to the mount 5*e*. With this closing position, the shutter 20 is confined by a spring 29 mounted to the inner top surface of the cartridge mount 5*e*, so that it is not removed. With this state, the shutter member 20 is sandwiched between projections 14*a*1 and 14*a*2.

Figure 11B:
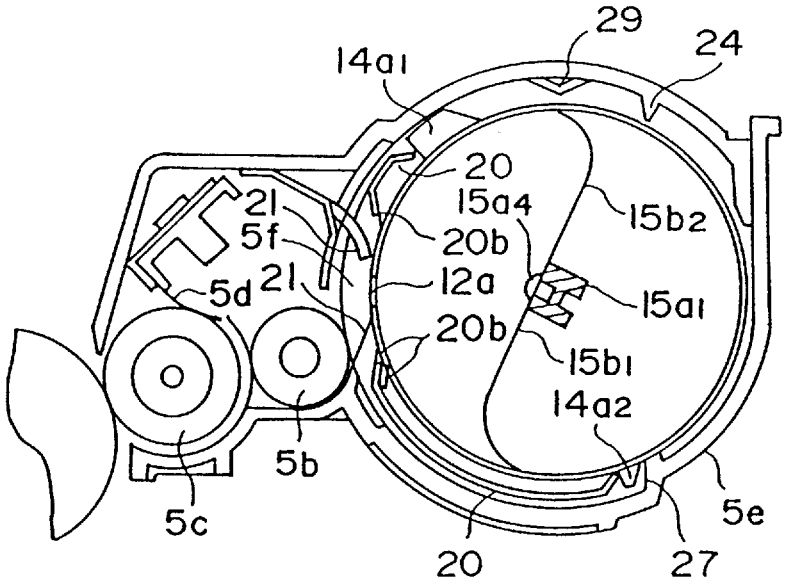
FIG. 11B illustrates a toner cartridge when it is rotated to an operable position.

When the toner cartridge C is rotated from the mounting and demounting position to the using position, the shutter 20 is urged by a projection 14*a*1 and therefore is rotated to open the opening 5*f*, as shown in FIG. 11B, to permit toner supply from the toner cartridge C into the developer chamber 5*a*.

Figure 12:
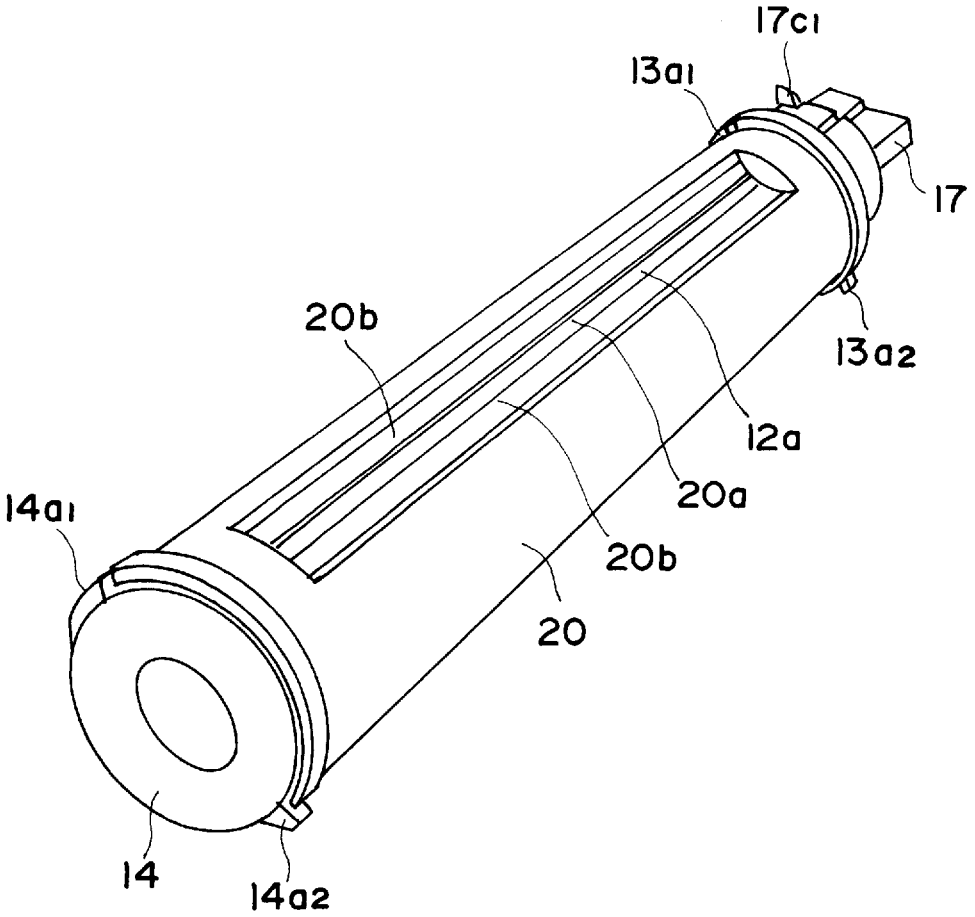
FIG. 12 illustrates engagement between a shutter and toner cartridge.

FIG. 12 shows a relation between the toner cartridge C and the shutter 20. The shutter 20, as shown in FIG. 12, is provided with an opening 20*a* in a semi-cylindrical surface along the periphery of the container 12. The configuration and size of the opening 20*a* are generally the same as the opening 12*a* of the container 12, or the opening 20*a* of the shutter member 20 is slightly larger. The shutter member 20 is an SUS or the like plate stamped out and bent. Around the internal surface of the opening 20*a*, a sealing member 20*b* is mounted to prevent the toner leakage (FIG. 11). The sealing member 20*b* is preferably elastic material such as polyester, polyurethane foamed material or the like. When the toner cartridge C is inserted into the mount 5*e*, the seal 20*b* is contacted to the outer surface of the toner cartridge C to prevent the leakage of the toner between the shutter 20 and the toner cartridge C. As shown in FIG. 11, a similar seal 21 is provided between the periphery of the opening 5*f* of the developer chamber 5*a* and the shutter 20, thus preventing the toner leakage therebetween.

(Toner Cartridge Mounting Process)

Figure 13A:
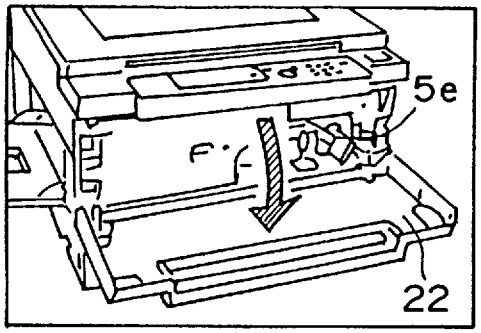
FIGS. 13(a)to (*f*) illustrate a mounting process of toner cartridge.
Figure 13D:
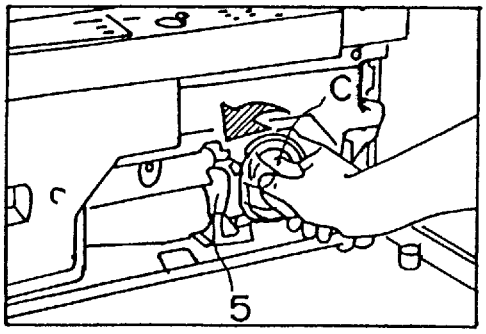
Figure 13B:
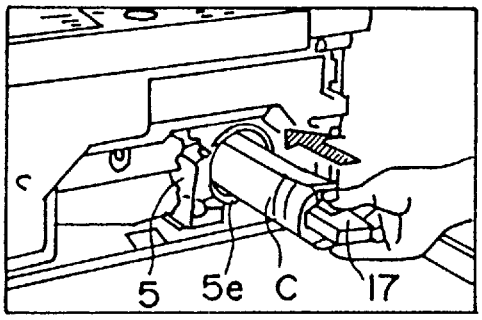
Figure 13E:
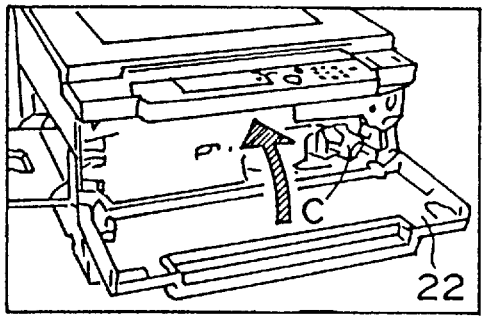
Figure 13C:
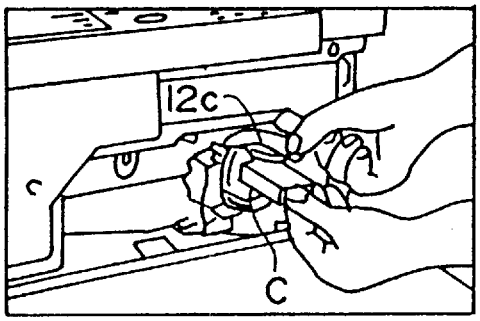
Figure 13F:
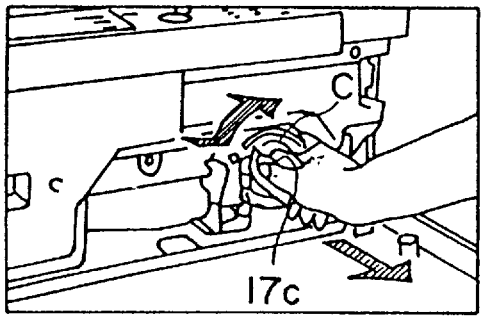

Description will be made as to the process of an operator mounting the toner cartridge C to the developing device 5. Referring to FIG. 13, a side cover 22 of a copying machine is opened (FIG. 13A), and the used-up toner cartridge C is removed, and thereafter, a fresh toner cartridge C is mounted to the cartridge mount 5*e* of the developing device 5 with the toner discharging opening 12*c* facing upward (FIG. 13B). Subsequently, the sealing member 12*c* for the opening 12*a* is removed (FIG. 13C), and the toner cartridge C is rotated about 90 degrees to bring the opening 12*a* into alignment with the opening 5*f* of the developing device 5 (FIG. 13D). At this time, the toner cartridge C is locked so as not to be rotated with the stirring member 15. Then, the side cover 22 is closed, so that the mounting of the toner cartridge C is completed (FIG. 13E).

When the toner cartridge C is removed, the lever 17*e* is operated to release the locking (FIG. 13F), and the reverse operation is carried out to remove it from the developing device 5.

In accordance with the above-described process, the functions of various parts when the operator mounts the toner cartridge C onto the developing device 5, will be described.

Figures 14A, 14B:
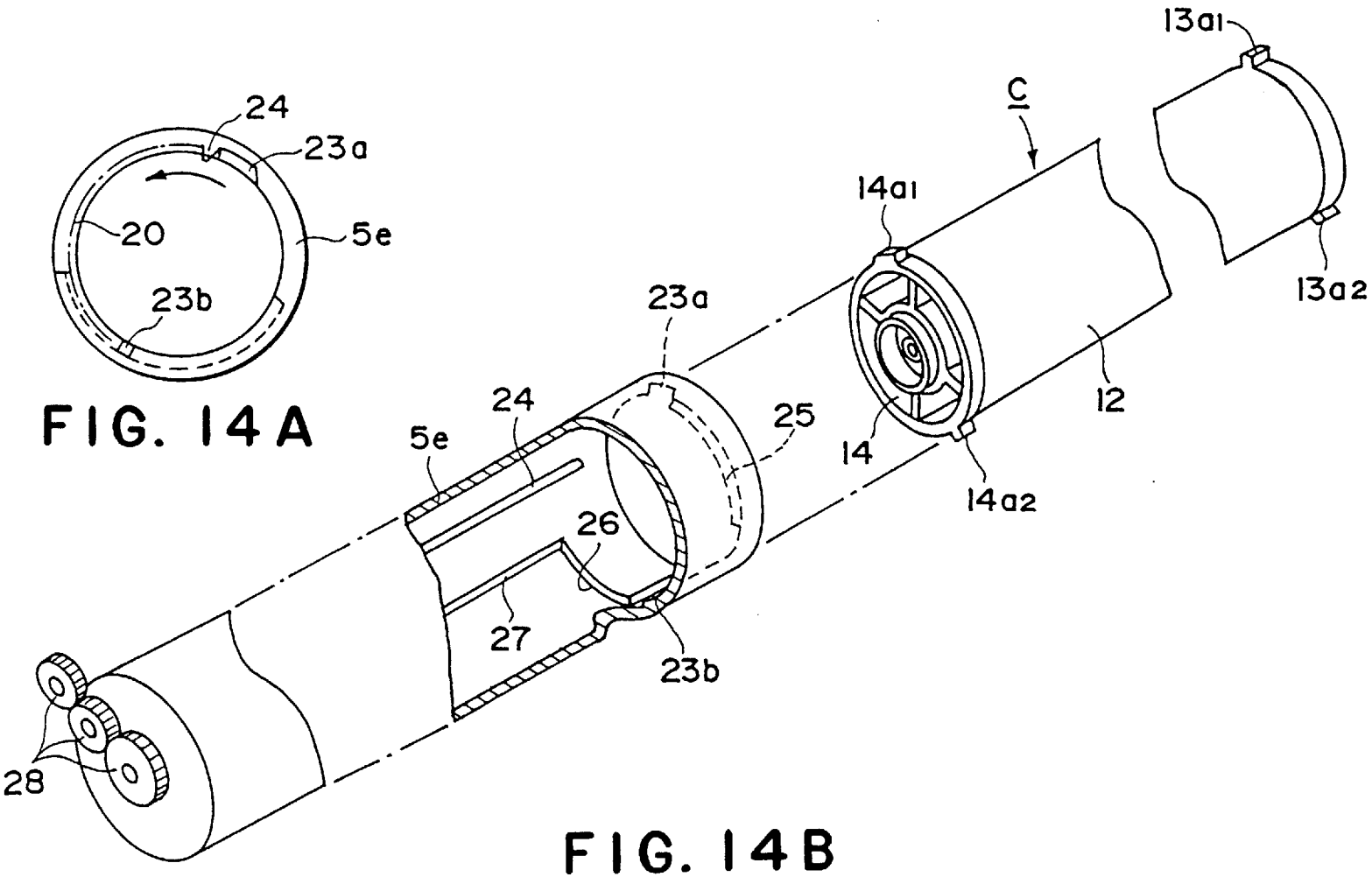
FIGS. 14(*a*) and (*b*) show a relation between the toner cartridge and toner cartridge mounting portion.

When the toner cartridge C is inserted into the cartridge mount 5*e*, two grooves 23*a* and 23*c* are formed at positions corresponding to the projections 14*a*1 and 14*a*2 of the flange 14, as shown in FIGS. 14*a* and 13*b*, and therefore, the insertion of the toner cartridge C is prevented unless they are aligned. The flange 13 is provided with projections 13*a*1 and 13*a*2. However, the angular positions thereof are aligned with the projections 14*a*1 and 14*a*2, and the corresponding projections 13*a*1 and 13*a*2 are of the same configurations, or the projections 13*a*1 and 13*a*2 are smaller, and therefore, the flange projections 13*a*1 and 13*a*2 are automatically insertable into the grooves 23*a* and 23*b*. By making the configurations of the grooves 23*a* and the projections 14*a*1 different depending on the kind of the toner cartridge C (the using developing device is different depending on the material of the toner), erroneous mounting of the toner cartridge C can be prevented.

The flange projections 14*a*1 and 14*a*2 have different sizes, and they are not diametrically opposite, and therefore, the insertion angle of the toner cartridge C is limited to one. Upon the insertion of the toner cartridge C, the opening 12*a* is controlled to face upward, by which the toner scattering upon the mounting or demounting of the toner cartridge C. When the used-up toner cartridge C is removed, the small amount of the toner remaining therein may scatter, but this is effectively prevented.

As shown in FIG. 14A, the inside surface of the cartridge mount 5*e* is provided with a guiding rail 24 parallel with the inserting direction of the cartridge, along which the flange projection 14*a*1 is guided. Therefore, when the operator does not insert the toner cartridge C to a predetermined position, the rotation of the toner cartridge C in the mounting direction (arrow in FIG. 14B) is not permitted. The guide rail 24, as shown in FIG. 14A, stops at a rear portion and the inlet portion of the cartridge mount 5*e*, and therefore, when the toner cartridge C is sufficiently inserted to a predetermined position, the flange projection 13*a*1 is out of alignment with the guide rail 24, and the projection 13*a*2 of the flange 13 is also out of alignment with the groove 23*b*, so that the rotation of the cartridge C in the mounting direction is permitted.

Figure 15A:
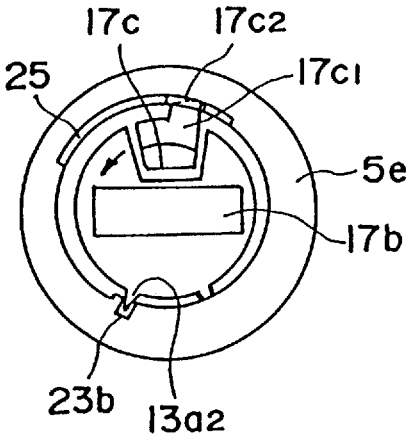
FIG. 15A illustrates a toner cartridge when it is inserted to a cartridge mount.

At an insertion end of the cartridge of the cartridge mount 5*e*, as shown in FIG. 14A, a jaw 25 is formed. When the operator inserts the toner cartridge C sufficiently in the cartridge mount 5*e*, as shown in FIG. 15A, the lever 17*c* deforms by elasticity, as a result of which a locking projection 17*c*1 goes beyond the jaw 25. By this, even when the operator peels the sealing member 12*c*1 covering the opening 12*a*, at the end 12*c*1, the locking projection 17*c*1 is engaged with the jaw 25, and therefore, the toner cartridge C is prevented from being removed from the cartridge mount 5*e* together with the sealing member 12*c*.

When the toner cartridge C is completely inserted, the opening 12*a* and the shutter opening 20*a* are in communication with each other as shown in FIG. 12, and the flange projections 13*a*1, 13*a*2, 14*a*1 and 14*a*2 are engaged with the end portions of the shutter member 20 with the four corners of the shutter being sandwiched thereby. By doing so, the shutter member is integrally rotatable with the rotation of the toner cartridge C.

Then, the sealing member 12*c* of the opening 12*a* is peeled off. At this time, since the toner cartridge C is completely accommodated by the cartridge 5*e*, the toner scattering or leaking can be prevented. Particularly in order to avoid the non-uniform distribution of the toner in the longitudinal direction of the toner cartridge, the toner cartridge is shaken or rolled conventionally. In such a case wherein the toner powder in the container 12 contains sufficient quantity of air so that the apparent density of the toner is low, and the flowability of the toner is high, the toner scattering effect is remarkably advantageous.

After the toner cartridge C is opened by peeling the sealing member 12*c* off, the operator then rotates the toner cartridge C to direct the toner discharging opening 12*a* in a predetermined direction. In this embodiment, the opening 5*f* of the developing device 5 is at a lateral portion of the toner cartridge C, and therefore, the opening 12*a* is directed substantially horizontally. Since the shutter 20 is sandwiched by the flange projections 13*a*1, 13*a*2, 14*a*1 and 14*a*2 of the toner cartridge C, as described above, when the toner cartridge C is rotated with the grip 17*b*, the shutter 20 is integrally rotated. At this time, the close contact is maintained between the outer peripheral surface of the toner cartridge C and the shutter member 20 and between the developer chamber 5*a* and the shutter 20, by the sealing members 20*b* and 21.

When the toner cartridge C is rotated, the projection 13*a*2 of the flange 13 is engaged to a stepped portion 26 of the cartridge mount 5*e*, as shown in FIG. 14A, and therefore, even if an attempt is made to remove the toner cartridge C halfway through the rotation, the projection 13*a*2 is confined by the step 26, so that the removal is not permitted.

The description will be made as to the relationship between the flange projection of the toner cartridge and the toner discharging opening 12*a* in this embodiment. If the flange projection is at any position away from a longitudinal extension of the toner discharging opening 12*a*, the rotation of the shutter 20 is permitted irrespective of whether it is provided on only one of the flanges 13 and 14. However, at least one flange projection is provided at each longitudinal end of the toner cartridge C since then the force relating to the opening or closing of the shutter 20 is distributed uniformly to the opposite ends of the shutter member 20 and the toner cartridge C, by which deformation of the toner cartridge C is prevented to permit smooth opening or closing motion of the shutter 20. In addition, projections 13*a*1 and 14*a*1 for moving the shutter 20 to open the opening 5*f* by engagement of the side surface with the shutter 20, and projections 13*a*2 and 14*a*2 for moving the shutter 20 to close the opening 5*f*, are separate portions from each other, and therefore, the load applied to the projection can be reduced.

In addition, as in this embodiment, two projections 13*a*1, 13*a*2, 14*a*1 and 14*a*2 for the opening and closing functions, respectively, are disposed at opposite positions with an extension of the opening 12*a* therebetween, at the longitudinal ends of the cartridge C. This is preferable. Particularly, the shutter 20 is sandwiched by the opening projections 13*a*1 and 14*a*1 and the closing projections 13*a*2 and 14*a*2.

The projections 13*a*1, 13*a*2, 14*a*1 and 14*a*2 may be fused or bonded on the toner replenishing container 12, or they may be integrally molded with the container 12. However, from the standpoint of the strength and the cost, they are preferably integrally molded on the flanges 13 and 14.

The ends, adjacent to the toner discharging opening 12*a*, of the flange projections 13*a*1, 13*a*2, 14*a*1 and 14*a*2, are engaged with the shutter 20 so that they receive the largest force upon the shutter opening and closing. For this reason, the component in the direction away from the center of the cylinder of the container 12 and the component toward the center, are as small as possible. Therefore, the ends, adjacent to the toner discharging opening 12*a*, of the flange projections 13*a*1, 13*a*2, 14*a*1 and 14*a*2, are substantially perpendicular to the outer peripheral tangent line of the cylinder at the portion.

The heights of the projections 13*a*1, 13*a*2, 14*a*1 and 14*a*2 are preferably such that they are projected beyond the outer surface of the container 12 by approx. 2–10 mm to ensure the engagement with the shutter 20 and to permit opening and closing motion of the shutter 20. The projection is further preferably 4–6 mm. If it is smaller than 2 mm, the degree of engagement is too small with the possible result that the engaging portion of the shutter 20 rides on the projections 13*a*1, 13*a*2, 14*a*1 and 14*a*2 upon the opening or closing of the shutter 20. If it is larger than 10 mm, the cartridge mount 5*e* becomes bulky.

Figure 16A:
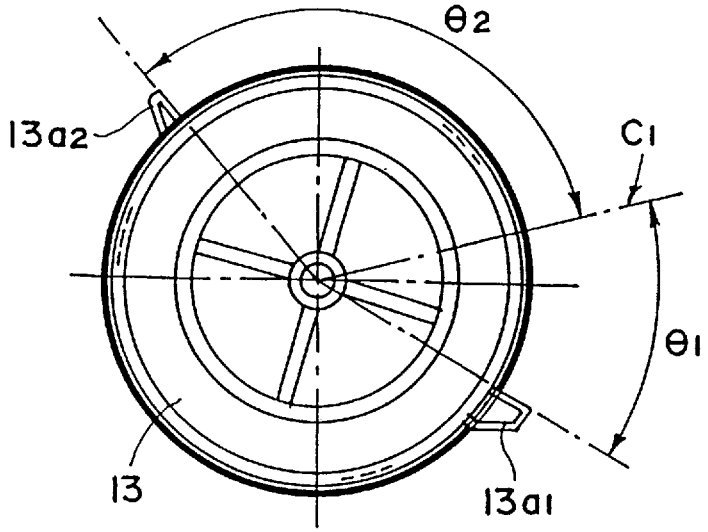
FIG. 16(*a*) and (*b*) show a positional relation between a toner discharge opening and a flange projection.
Figure 16B:
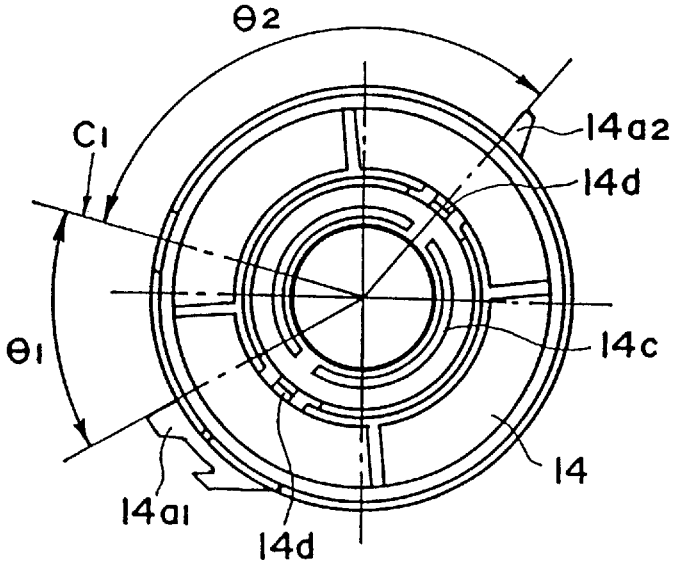

The positional relationship between the toner discharging opening 12*a* and the projections 13*a*1 and 13*a*2 (first projections) and projections 14*a*1 and 14*a*2 (second projections) with the opening 12*a* therebetween, will be described as to the circumferential direction. As shown in FIG. 16, an angle formed between a line connecting the center of the cylinder of the container 12 and the center C1 in the longitudinal direction of the toner discharging opening 12*a* and a line connecting the center of the cylinder and an end of the projections 13*a*1 and 14*a*1 adjacent to the toner discharging opening, is θ1, and an angle formed between a line connecting the center of the cylinder and the longitudinal center C1 of the toner discharging opening 12*a* and the ends of the projections 13*a*2 and 14*a*2 adjacent to the toner discharging opening and the center of the cylinder, is θ2. The angle θ1 is preferably approx. 20–90 degrees, further preferably approx. 30–50 degrees, even further preferably approx. 40–50 degrees. The angle θ2 is preferably approx. 70–160 degrees, further preferably 105–130 degrees, even further preferably approx. 110–120 degrees. In this embodiment, the angle θ1 is 45±1 degrees, and θ2 is 115±1 degrees.

If the angle θ1 is smaller than 20 degrees and θ2 is smaller than 70 degrees, the projections 13*a*1, 13*a*2, 14*a*1 and 14*a*2 are close to the opening 12*a* of the less rigid toner container 12, and therefore, the toner discharge opening 12*a* is easily deformed during the opening and closing operation of the shutter. In addition, the space for the seal 20*b* is limited. If the angle θ1 is larger than 90 degrees, or θ2 is larger than 160 degrees, the circumferential length of the shutter 20 becomes long with the result of larger operational force required for the opening and closing of the shutter 20.

In this embodiment, as described hereinbefore, shutter opening projections 13*a*1 and 14*a*1 and shutter closing projections 13*a*2 and 14*a*2 are provided at the longitudinally opposite ends of the toner replenishing container 12. If the projection is provided only one longitudinal end of the container 12, the positions of the projections facing to each other with the toner discharging opening 12*a* therebetween are such that the line connecting the center of the cylinder and the longitudinal center of the opening 12*a* and the line connecting the center of the cylinder and the projection side end adjacent to the toner discharging opening 12*a* forms an angle between approx. 20–160 degrees, for the reasons described in the foregoing.

When the toner cartridge inserted into the cartridge mount 5*e* is rotated in the mounting direction, the flange projections 13*a*1 and 14*a*1 for the shutter closing are engaged with the shutter 20 so that the cartridge C and the shutter 20 are integrally rotated. This rotation is limited upon the flange projections 13*a*2 and 14*a*2 being abutted to the step 27 of the cartridge mount 5*e*, as shown in FIG. 14A. At this time, the opening 12*a* of the container 12 and the opening 20*a* of the shutter 20 are directed substantially horizontally so that they are in communication with the opening 5*f* of the developing device 5 (FIG. 11B).

Figure 15B:
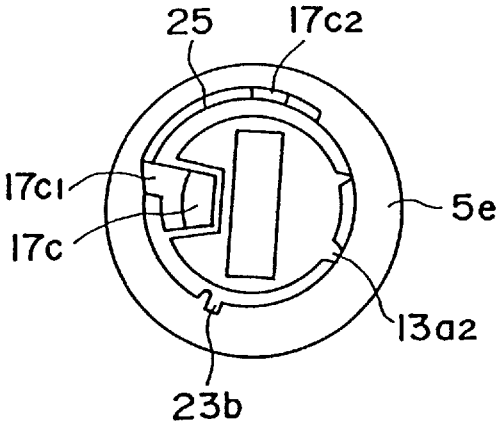
FIG. 15B and 15C illustrate a toner cartridge when it is locked at a mounting position.
Figure 15C:
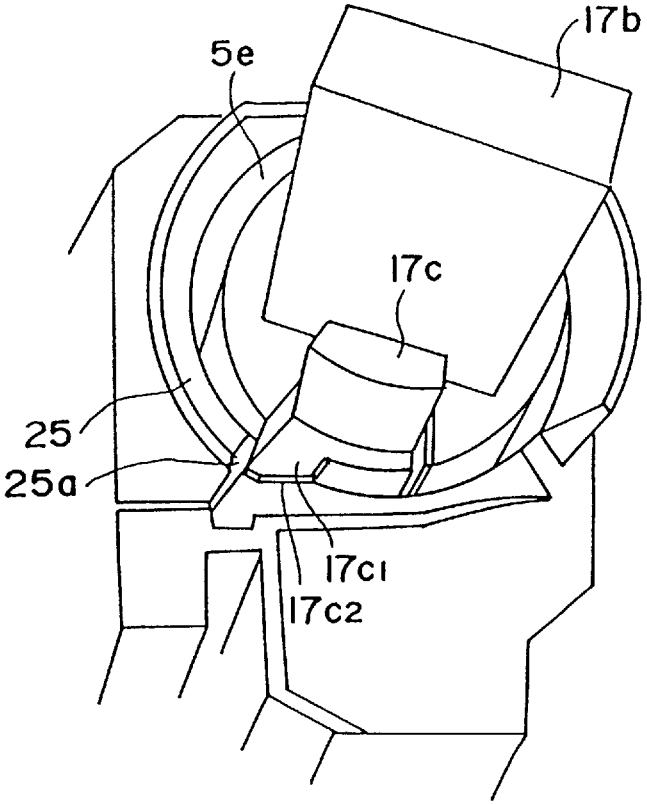

When the toner container 12 is rotated to the stop position in this manner, the movable lever 17*c* is elastically deformed as shown in FIGS. 15B and 15C, so that the locking projection 17*c*1 goes over the end 25*a* of the jaw 25 of the cartridge 5*a* to automatically engage with the end. By doing so, even if the cartridge C is rotated in the clockwise direction, the rotation is prevented because of the engagement between the projection 17*c*1 and the jaw end.

In order to promote the motion of the projection 17*c*1 beyond the end 25*a* when the cartridge C is rotated in the mounting direction, an inclined surface 17*c*2 is formed. Therefore, even if the lever 17*c* is not pressed, when the cartridge C is rotated in the mounting direction, the locking projection 17*c*1 is abutted to the end 25*a* of the jaw, and the lever 17*c* elastically deforms along the inclined surface 17*c*2, so that the locking projection 17*c*1 goes beyond the end 25*a*. After this, the movable lever 17*c* elastically deforms with the result of automatically locking. By this click, the operator can sense the assured mounting of the toner cartridge C.

By the mounting of the toner cartridge C, the gear 15*a*2 of the stirring member 15 is engaged with a driving gear 28 of the main assembly to permit rotation, as shown in FIG. 14A.

(Toner Feeding Operation)

In the manner described above, the toner cartridge C is mounted to the developing device 5 to permit image forming operation. The description will be made as to the toner feeding from the toner cartridge C during the image forming operation.

During the image forming operation, the driving force is transmitted to the stirring member 15, and the member 15 rotates in the clockwise direction in FIG. 11B at 10.2 rpm, for example. By this, the toner in the toner replenishing container 12 is sufficiently stirred and uniformed by the stirring blade 15*b*, and in addition, it is properly electrically charged. The toner is fed to the developer chamber 5*a* of the developing device 5 through the toner discharge opening 12*a*, the shutter opening 20*a* and the opening 5*f* of the developing device. At this time, the toner discharge opening 12*a* is directed substantially horizontally, and therefore, a large amount of unstirred or uncharged toner is prevented from being supplied into the developing device 5 at once. With the reduction of the toner in the toner replenishing container 12 as a result of developing operation, the toner feeding force by the stirring member 15 is sufficiently strong, and therefore, the amount of the toner in the developer chamber 5*a* is maintained at a constant level.

This is because the stirring blades 15*b* are of elastic material, and the rotational radius thereof is slightly longer than the radius of the cylinder of the toner container so that the ends thereof are slightly extended out of the toner discharging opening 12*a*. More particularly, the blade 15*b* is slightly deformed as a result of the friction with the internal wall surface of the container 12, but at the toner discharging opening 12*a*, it is elastically restored to throw the toner into the developing device 5. The elastic throwing of the toner is not strong when the amount of the toner in the container 12 is large because the existence of the large amount of the toner functions as resistance, and therefore, toner agglomeration as a result of excessive amount of the toner in the developing device 5 and the improper image formation attributable to the agglomeration, can be prevented. In addition, when the stirring rod 15*b* is deformed, the increase of the required torque is prevented. On the other hand, in accordance with the reduction of the amount of the toner in the container 12, the restoring action of the blade 15*b* becomes smooth, so that higher toner feeding power is provided.

For this reason, very little amount of the toner remains unused in the container 12. Since the blades 15*b* are in sliding contact with the internal wall of the container, the occurrence of cause particle of the toner is prevented.

As described in the foregoing, if the stirring blade 15*b* is rotated while being in sliding contact with the internal wall of the toner replenishing container 12, it would be considered that the toner cartridge C is rotated by the rotation of the stirring member 15. However, in this embodiment, the locking projection 17*c*1 is abutted to the jaw 25 of the cartridge mount 5*e* (FIG. 15B and FIG. 15C), and the toner cartridge C is not rotated thereby, thus maintaining the position of the toner discharge opening 12*a* (particularly the angular position at the bottom edge) in a stabilized manner, thus stabilizing the toner supply amount and the image quality.

It is preferable that the bottom edge of the toner discharge opening 12*a* is within ±10 degrees, further preferably ±5 degrees, when the horizontal direction of the center of the cylinder of the container 12 is 0 degrees, when the cartridge C is mounted. In this embodiment, the angle is −3.6 degrees.

(Demounting of the Toner Cartridge from the Developing Device)

When the cartridge C is demounted from the developing device 5, the operator lowers the lever 17*c* of the grip 17 toward the gripping portion 17*b* from the position of use shown in FIG. 15*b* and 15*c* to release the engagement between the locking projection 17*c*1 and the end 25*a* of the jaw 25. The cartridge C is then rotated in the clockwise direction toward the mounting and demounting position (pose), thus returning the opening 12*a* to the top. Then, the toner cartridge C is pulled out of the cartridge mount 5*e*. At this time, the toner cartridge C is not pulled out unless it is rotated to the extent that the opening 12*a* is directed upward, conversely to the case of the toner cartridge C mounting.

The rotational direction of the toner cartridge C from the mounting and demounting position to the use position is opposite from that of the toner cartridge C from the use position to the mounting and demounting position. When the toner cartridge C is rotated from the use position to the mounting and demounting position, the projections 13*a*2 and 14*a*2 are moved to a position for the shutter member to close the opening 5*f*.

Throughout the mounting, using, and demounting of the toner cartridge C, the outer surface of the toner replenishing container 12*a* and the shutter 20 are closely contacted so that the sealing is maintained. Therefore, the toner is not deposited on the outer peripheral surface of the used up toner cartridge C, when it is removed from the developing device 5, and therefore, the operator's hands or wearings are not contaminated with the toner. Therefore, it is easy to dispose of the toner cartridge C when used up. As described hereinbefore, the toner feeding force of the stirring member 15 is high so that the remaining amount of the toner in the used-up cartridge C is very small, and therefore, the toner scattering or the like can be prevented while the used-up toner cartridge C is disposed of.

(Recycling Process)

The toner cartridge C used in this embodiment is operated for the image formation in the manner described above. After the toner is used up, it is reusable through a recycling process which will be described hereinafter.

(1) The grip 17 is removed from the flange 13.

This can be accomplished by operator's manipulation so that the engaging claw 17*a*2 of the grip 17 is disengaged from the engaging recess 13*e* of the flange 13. However, the strength against pulling when the grip 17 is pulled straight is approx. 30 kgf, and therefore, a certain tool or apparatus is preferably used.

(2) The cap 16 is removed from the flange 13.

This can also be accomplished manually. However, a nipper or another proper tool is usable. However, when the cap 16 is to be reused, it is preferably removed by hand or another proper tool so as to avoid damage to the cap 16.

(3) An outer surface and inner surface of the toner replenishing container 12 are cleaned.

As a cleaning method, air blow or vacuum sucking is effected, and thereafter, the toners are wiped out by waste. The cleaning of the inside surface of the container 12 may be omitted when the grip 17 and the cap 15 are to be reused, and they are also cleaned.

(4) The toner discharge opening 12*a* of the toner replenishing container 12 is sealed by a sealing member 12*c*.

The sealing member 12*c* has been removed after starting of the use of the toner cartridge C and is thrown away normally, and therefore, the toner cartridge C collected back after the use-up thereof is not provided with the seal 12*c*. Therefore, a fresh seal 12*c* is mounted using adhesive or hot melt adhesive to seal the toner discharge opening 12*a*. A heat sealing using easy peel bonding layer is usable.

(5) The sealing property of the container 12 is checked.

The air is supplied through the toner filling opening 13*b* while the bore 14*b* of the flange 14 is plugged. In doing this, the air leakage is detected (air leak test) to check the sealing property of the container 12. This sealing check may be omitted, and in this case, the toner leakage may be checked after the toner is filled.

(6) Torque required by the stirring member 15 is checked.

In this step, it is checked whether the required torque of the stirring member 15 is too high or not. This checking may be omitted.

(7) The toner is filled through the filling opening 13*b*, and the cap 16 is pressed into the filling opening 13*b*.

The toner filling may be carried out manually. However, an auger filler is preferably used, as shown in FIG. 8. The amount of the filled toner is preferably the same as that in the case of the original one. However, it may be increased or reduced.

The cap 15 is preferably reused from the standpoint of recycling percentage. However, the cap 16 may be a fresh one. In this case, the cap may be the one different from the original if it is sufficient to hermetically plug the filling opening 13*b*.

(8) The outer surface of the container 12 is cleaned.

The cleaning method is similar to (3), and after the air blow or vacuum cleaning is carried out, it is wiped by waste or the like. This step can be omitted.

(9) Toner leakage is checked.

This is effected in order to check whether the toner leaks from the container 12 or not. This step may be omitted.

(10) Mounting the grip 17.

The removed grip 17 is pressed into the flange 13 to engage the engaging claw 17*a*2 of the member 17 into an engaging recess 13*e* of the flange 13, so that the grip 17 is mounted to the flange 13. If the engaging claw 17*a* is damaged upon the removal of the grip 17 (1), a fresh grip 17 is usable.

By collecting the used cartridge, and refilling the toner, the toner cartridge C can be recycled, by which resources, and energy can be saved, and the production of the wasteful material can be reduced.

(Another Embodiment)

The description will be made as to another example. The same reference numerals as in the foregoing embodiment are used for the elements having the corresponding functions.

(Another Embodiment of the Toner Cartridge)

The stirring member, the toner replenishing container, the grip, and the recycling process, will be described in this order.

(Another Embodiment of the Stirring Member)

Figure 17:
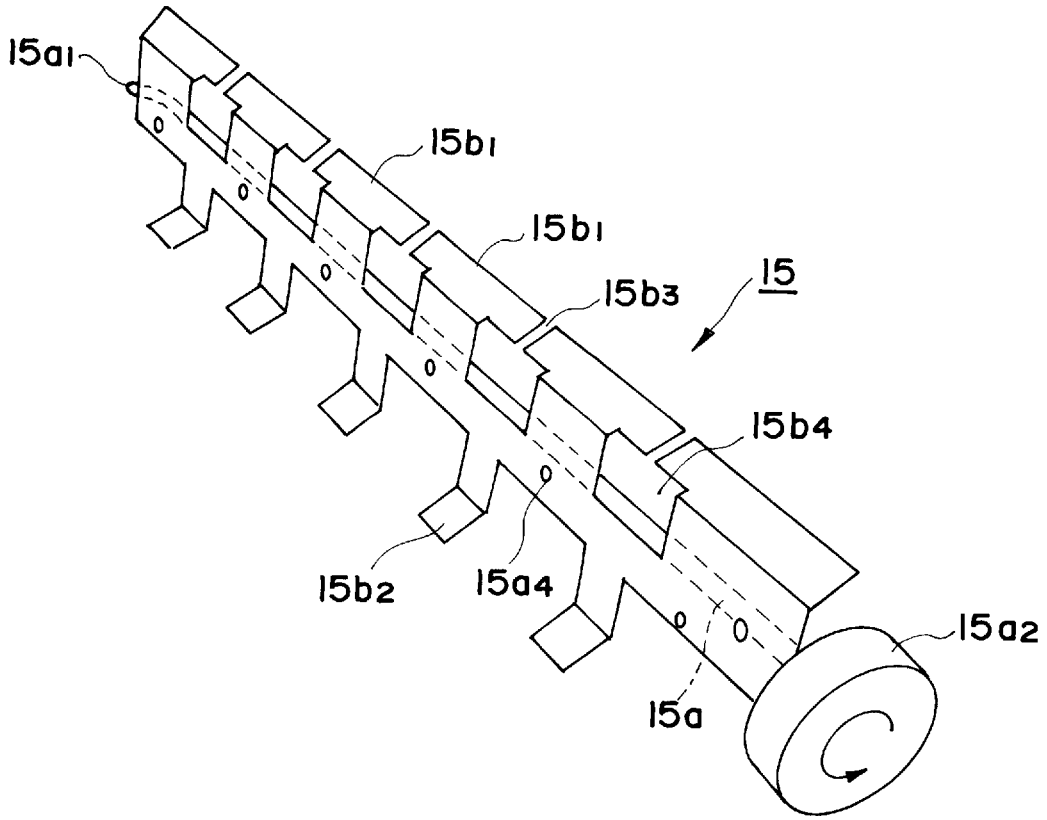
FIG. 17 illustrates another embodiment of the stirring member.

In the embodiment of FIG. 17, the main blade portion 15*b*1 and the auxiliary blade portion 15*b*2 are bent toward downstream with respect to the rotational direction of the stirring member 15. In this case, the end portion of the blade obliquely approaches the toner, and therefore, the required torque of the stirring member 19 is reduced.

With this configuration of the stirring member 15, when the blade end approaches the toner discharging opening 12*a* and the toner is thrown by the rebounding of the blade, the horizontal component of the toner throwing increases so that not only the force scooping the toner from the bottom of the container 12 to the toner discharge opening 12*a* but also the force for feeding the toner from the toner discharging opening 12*a* to the developing device 5.

In a compact developing device in which the developer chamber 5*a* and the cartridge mount 5*e* are substantially horizontal and parallel, the configuration of the stirring blade 15*b* is effective. If the blade 15*b* is bent in this manner, the contact angle between the end of the stirring blade and the internal wall of the toner supply chamber is relatively small as compared with the first embodiment, and the coarse particle occurrence of the toner is reduced.

When the stirring blade 15*b* is bent in this manner, the bending angle is preferably approx. 0–90 degrees, preferably approx. 20–90 degrees, even further preferably 40–90 degrees, from the standpoint of reduction of the required torque and increase of the toner feeding force. In addition, the bent portion of the blade is positioned at approx. 50–95%, further preferably approx. 60–90% and even further preferably approx. 70–80% of the total length of the blade away from the rotational axis.

Figure 18:
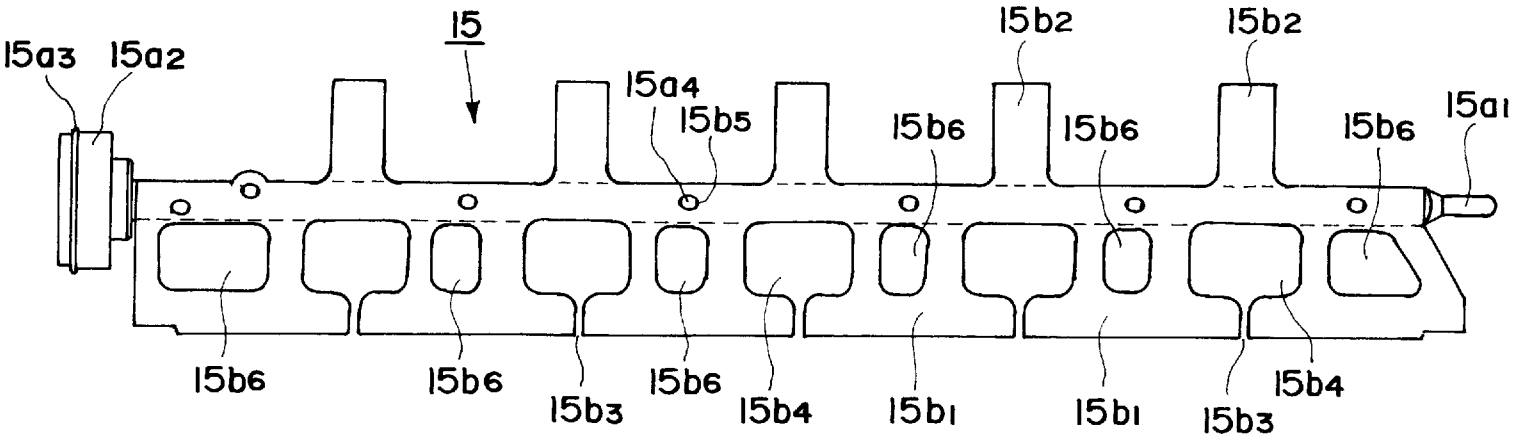
FIG. 18 illustrates a stirring member having a toner passing window in a main blade portion.

The stirring blade 15*b* may be constructed as shown in FIG. 18. In the embodiment of FIG. 18, a plurality of toner passing windows 15*b*6 are formed between the holes 15*b*4 of the main blade 15*b*1. By doing so, the toner passes not only through the holes 15*b*4 but also through the windows 15*b*6 when the stirring member 15 rotates during image forming operation so that the torque required by the stirring member 15 can be reduced. By properly selecting the size of the windows 15*b*6, the rigidity of the main blade portion 15*b*1 can be adjusted so that the toner can be thrown through the discharge opening 12*a* with proper strength.

(Another Embodiment of the Toner Replenishing Container)

Figure 19:
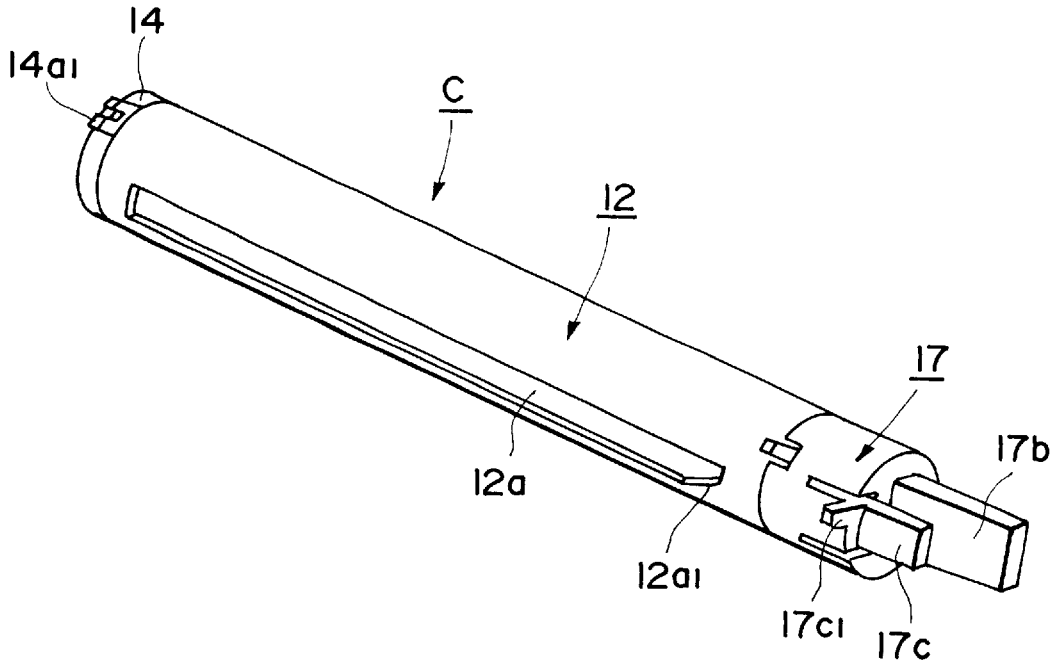
FIG. 19 illustrates an embodiment wherein a corner of a toner discharge opening is inclined.

Another embodiment of the container 12 will be described. In the first embodiment, the toner discharge opening 12*a* is rectangular (FIG. 4). In the FIG. 19 embodiment, the corner of the rectangular shape adjacent the grip 17 (the bottom corner when the cartridge C is mounted to the developing device 5, in this embodiment) 12*a*1 is tapered to provide a narrower portion than the opening portion.

When the image is formed after mounting the toner cartridge C to the developing device 5, a larger amount of the toner is discharged through the corner adjacent to the grip 17. By reducing the width at the corner in the manner described above, the toner is more uniformly discharged over the entire area of the opening 12, and the toner leakage can be prevented.

Figure 20:
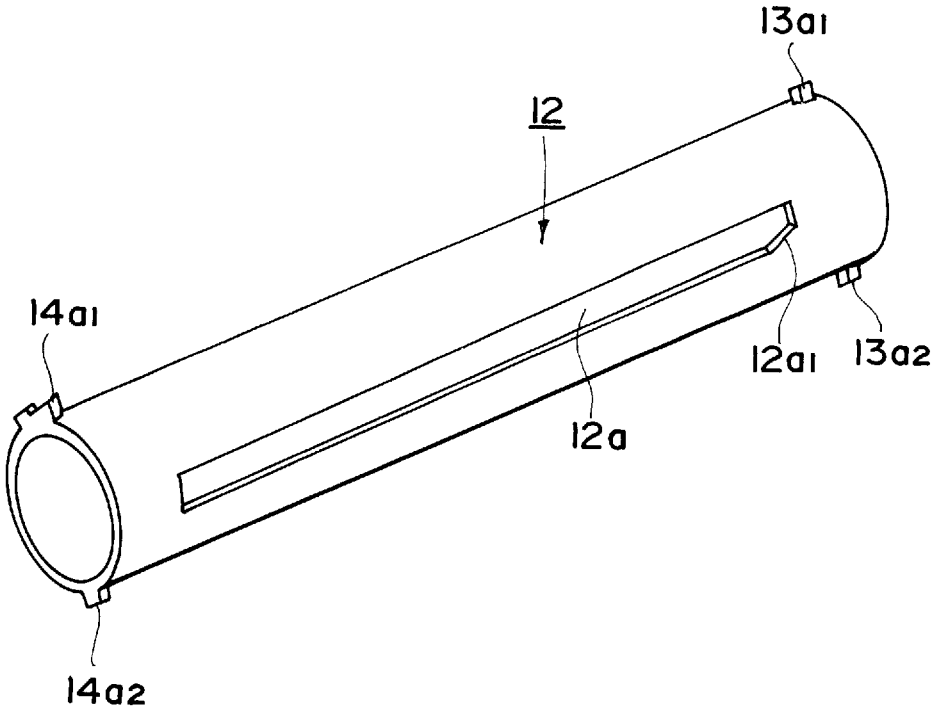
FIG. 20 illustrates an embodiment wherein a toner replenishing container has an integral projection for driving a shutter.

In the above-described first embodiment, the shutter 20 is integrally rotated with the cartridge C when the toner cartridge C is mounted or demounted. For this purpose, the flanges 13 and 14 are provided with projections 13*a*1 and 13*a*2, and 14*a*1 and 14*a*2, respectively, for engagement with an end of the shutter 20. The projections 13*a*1 and 13*a*2, and 14*a*1 and 14*a*2, may be provided at a longitudinal end of the container 12, as shown in FIG. 20, rather than the flanges 13 and 14.

Figure 21:
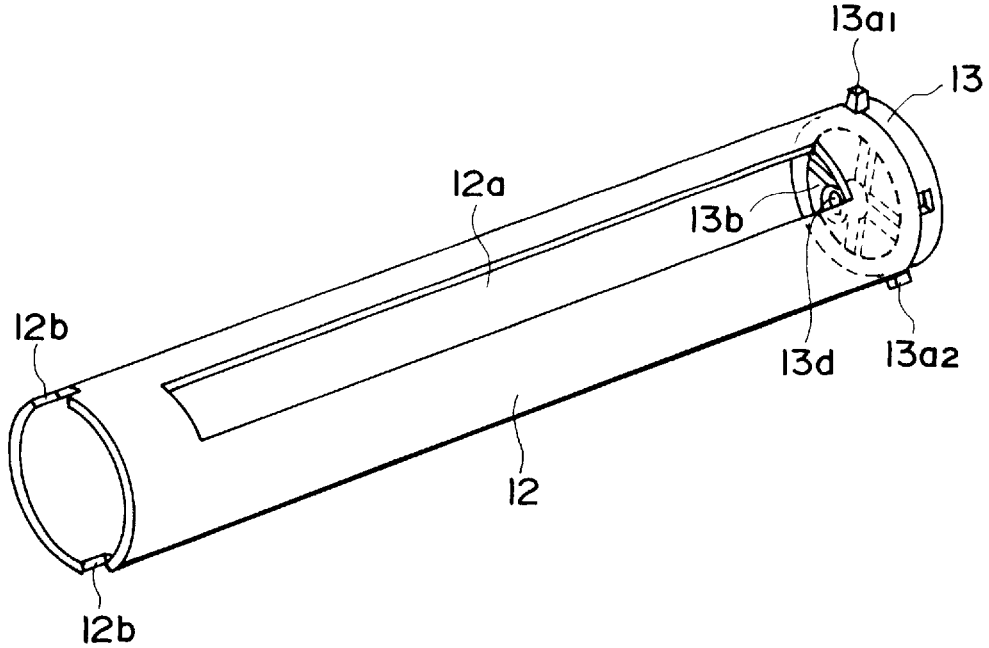
FIG. 21 illustrates an embodiment wherein a toner replenishing container has an integral flange at one end.

Otherwise, at least one of the flanges 14 and 14 and the container 12 may be integrally formed. In this case, as shown in FIG. 21, it is preferable that the flange having the filling opening 13*b* is integrally formed since then tilting or metal core can be prevented. As the molder in this case, ultra-high speed and high pressure injection molder is preferably used, and the ejection pressure is 500–1500 kgf/cm$^2$, and the filling time of the resin is 0.005–0.02 sec approximately, as preferable levels.

The projections 13*a*1, 13*a*2, 14*a*1 and 14*a*2 are required to have a predetermined angular relationship with the toner discharge opening 12 formed in the toner replenishing container 12 (FIG. 17), and therefore, when the toner container 12 is injection molded, the above-described integral forming is effective to make the positioning more accurate without difficulty.

(Another Embodiment of the Grip)

Figure 22:
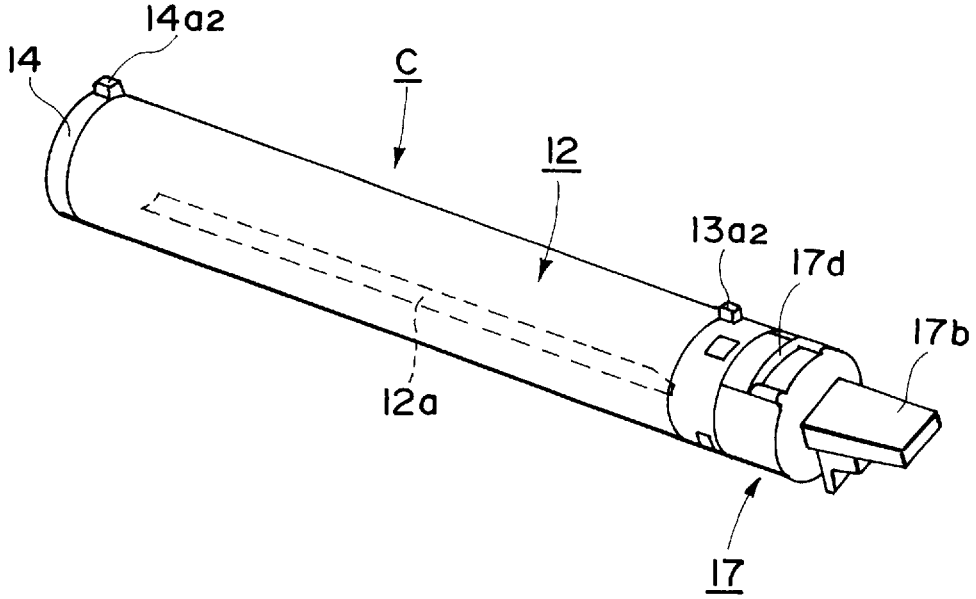
FIG. 22 illustrates an embodiment wherein a grip has an "H" shaped rib.

The grip 17 may be constructed as shown in FIG. 22. In this embodiment, the grip 17 is provided with a rib 17*d* in the form of an "H" at a position opposite from the side having the toner discharge opening 12*a* when it is mounted to the predetermined position of the engaging portion 17*a*, that is, the toner container 12.

With this structure, when the toner cartridge C is mounted to the developing device 5 by insertion to the cartridge mount 5*e* and with the rotation as shown in FIG. 12B, the H rib 17*d* of the grip 17 is contacted to the inner surface of the cartridge mount 5*e*, thus pushing the toner cartridge C toward the left in FIG. 12B. By doing so, the container 12 is more closely contacted to the seal 21 formed in the opening 5*f*, so that the toner discharged through the discharge opening 12*a* does not leak into the cartridge mount 5*e*, but is assuredly supplied to the developer chamber.

(Another Embodiment of Recycling)

In the case that the used-up toner cartridge C is collected for recycling, the grip 17 and cap 16 are removed, and the toner is refilled through a toner filling opening 13*b* in the first embodiment described above. It is a possible alternative that the toner is refilled through the toner discharge opening 12*a* without removing the grip 17 or cap 16.

The recycling process is as follows.

(1) The outer and inner surfaces of the container 12 are cleaned.

This cleaning is effected with the grip 17 and the cap 16 maintained on the cartridge C. The cleaning method is the same as in the first embodiment, that is, after the air blow or vacuum sucking, they are wiped by waste or the like. The cleaning of the inner surface of the container 12 may be omitted without problem.

(2) Torque required by the stirring member 15 is checked.

The checking is effected as to whether the torque required by the stirring member 15 is too high or not. The checking may be omitted.

(3) Toner is filled through the toner discharge opening 12*a*.

Since the cap 16 plugging the toner filling opening 13*b* is not removed, the toner is refilled through the opening 12*a* of the container 12. For this toner filling, the auger filler is preferably used as in the first embodiment, but manual refilling is possible.

(4) The opening 12*a* is sealed by a seal 12*c*.

Since the toner filling opening 13 is capped with the cap 16, the opening 12*a* is sealed by the seal 12, by which the toner is completely sealed in the container 12. The material and sealing method of the sealing member 12*c* is the same as in the first embodiment.

(5) An outer surface of the container 12 is cleaned.

The cleaning method is similar as in the cleaning before the toner refilling, that is, after the air blow or vacuum sucking cleaning, the outer surface is wiped by waste or the like. This step may be omitted.

(6) Toner leakage is checked.

The checking is effected as to whether or not the filled toner does not leak out of the container 12. This step may be omitted.

By filling the toner through the opening 12*a* of the container 12, the toner cartridge C can be easily recycled without removing the grip 17 or cap 16.

(Another Embodiment Using Process Cartridge)

In the first embodiment, the photosensitive drum 2 and/or the developing device 5 or the like constituting the image forming station, are provided in the main assembly of the apparatus, and the toner cartridge C for replenishing the toner is detachably mountable. The sealing structure (FIG. 10) for preventing the toner leakage between the bore 14*b* of the flange 14 of the toner cartridge C and the gear 15*a*2 which is a drive transmitting portion for the starting member 15, is similarly applicable to a process cartridge.

Figure 23:
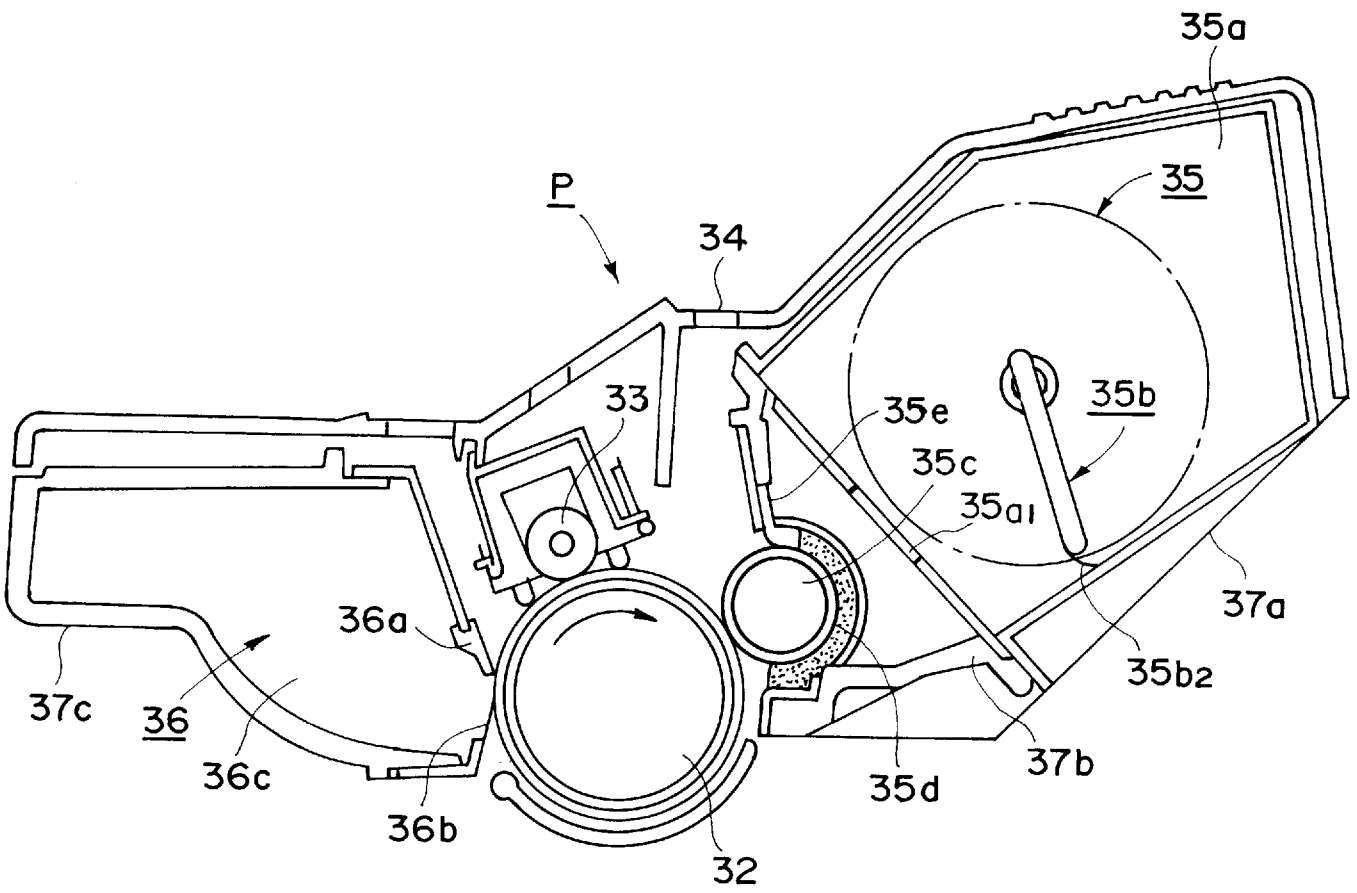
FIG. 23 illustrates a process cartridge.

The process cartridge contains as a unit a photosensitive drum, a charging device, a developing device and a cleaning device, for example. As shown in FIG. 23, for example, a photosensitive drum 32 having a photosensitive layer is rotated, and the surface thereof is uniformly charged by voltage application by a charging roller 33 (charging device). The photosensitive drum 32 is exposed to image light from an image reader through an exposure station 34 so that a latent image is formed. The latent image is in turn developed by a developing device 35. The developing device 35 feeds the toner by the stirring member 35*b*, and a developing sleeve 35*d* containing therein a stationary magnet 35*c* is rotated. By the function of a developing blade 35*e*, a layer of toner having triboelectric charge is formed on the surface of the developing sleeve 35*d*. The toner is transferred onto the photosensitive drum 32 in accordance with the latent image, by which a toner image is formed as a visualized image. A transfer device in the main assembly is supplied with a voltage having a polarity opposite from that of the toner, so that the toner image is transferred onto a recording material 9. Thereafter, the residual toner remaining on the photosensitive drum 32 is scraped off by a cleaning blade 36*b*, and is received by a receiving sheet 36*b*. The received toner is collected in a residual toner container 36*c*. In this manner, the residual toner is removed from the photosensitive drum 32. Bias parts such as the photosensitive drum 32 are contained in a housing connected with the toner container 37*a*, the developing frame 37*b* and cleaning container 37*c*, thus constituting a cartridge. The cartridge is detachably mountable to a cartridge mount in the main assembly of the image forming apparatus.

The process cartridge B contains the toner replenishing container 35*a* and the photosensitive drum 32 or the like, as well, and therefore, the toner replenishment is facilitated, and in addition, the maintenance of the photosensitive drum 32 or the like is also facilitated.

In the process cartridge P, the stirring member 35*b* has an integral coupling gear 35*b*3 at an end of the stirring shaft 35*b*1. The stirring shaft 35*b*1 is provided with stirring blade 35*b*2 which is similar to that in the first embodiment. This is rotatably supported on the toner replenishing container 35*a* to feed the toner out of the container through a toner discharge opening 35*a*1. The sealing structure between the gear 35*b*3 of the stirring member 35*b* and the container 35*a* is made the same as that described in conjunction with FIG. 10 in the first embodiment, by which the similar effect as in the first embodiment can be provided.

Between the gear 35*b*3 which is a drive transmitting portion for the stirring member 35*b* and the toner replenishing container 35*a*, a flat ring gasket is compressed as a sealing member (wool felt compressed at compression ratio 4–40 %, for example). The engaging portion between the gear 35*b*3 and the toner container 35*a* (for example, the engaging portion of a claw of the container 35*a* and a portion for engagement therewith in the gear 35*b*3) is outside the toner container beyond the gasket, as a result of which the toner does not leak to the engaging portion during the image forming operation, and the production of coarse toner particles can be prevented beforehand.

Figure 24A:
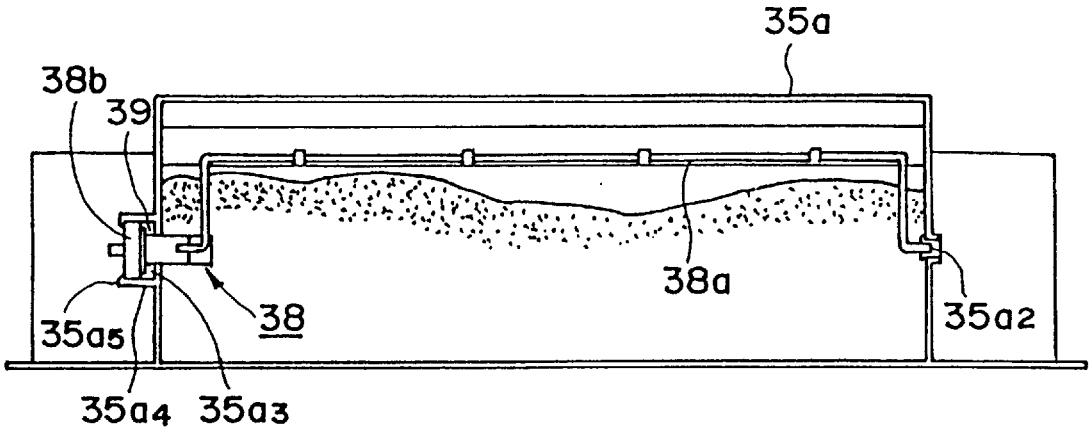
FIG. 24(*a*) and (*b*) show illustrates another embodiment of a stirring member in a process cartridge.

The stirring member may be constructed as shown in FIG. 24A, as well as being constructed with a flexible member. That is, the stirring member 38 comprises a rod member 38*a* bent to stir the toner, and a gear 38*b* as a drive transmitting member, as separate members from each other. When the stirring member 38 is assembled, the rod member 38 is inserted through a toner discharge opening 35*a*1, and another end is inserted into a recess 35*a*2 of the container 35*a*. Subsequently, the gear 38*b* is inserted through the bore 35*a*3 in the container 35, and is mounted to the other end of the rod 38*a*. The stirring member 38 is rotatably mounted to the container 35*a*. At this time, in order to prevent the toner leakage between the bore 35*a*3 of the container 35*a* and the gear 38*b*, a flat ring wool felt gasket 39 is interposed as a sealing member with a compression ratio of 4–40%.

Figure 24B:
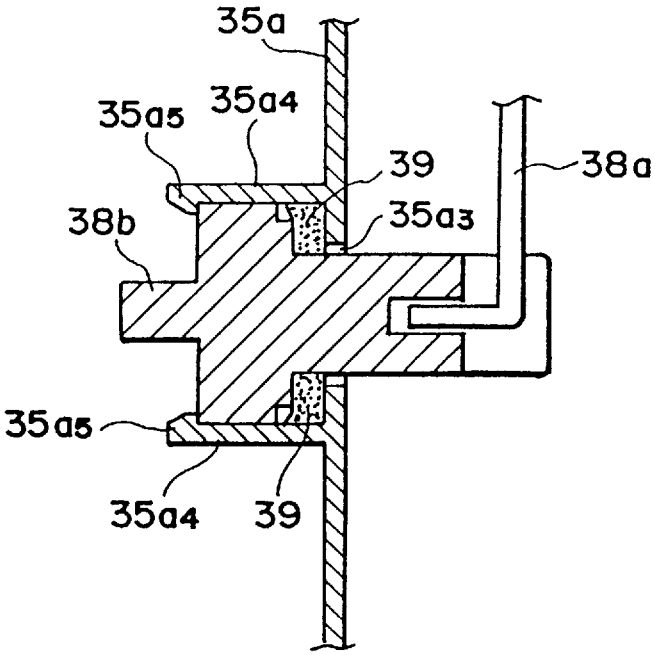
Figure 25:
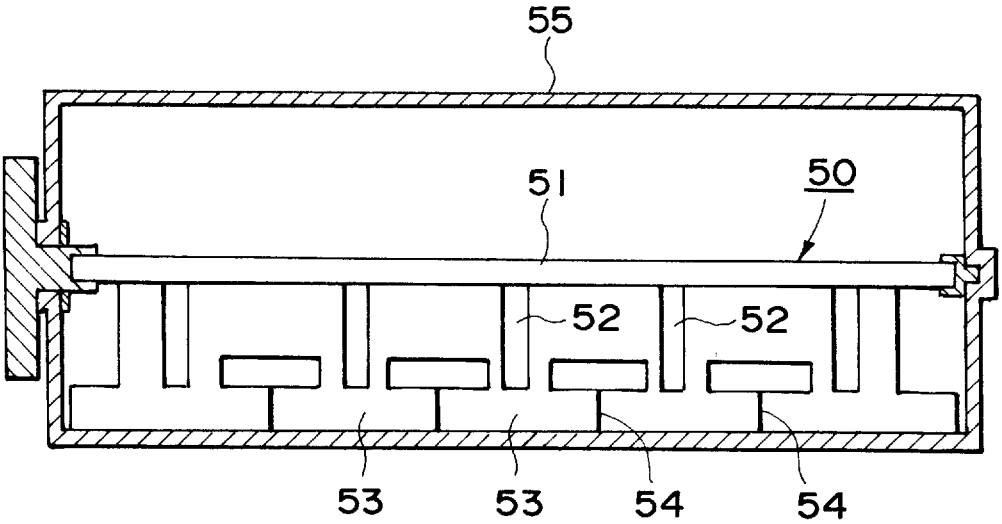
FIG. 25 illustrates a stirring member used in an experiment.

The engaging portion between the gear 38*b* and the toner replenishing container 35, as shown in FIG. 24B, are provided with a locking claw 35*a*5 at an end of the jaw 35*a*4 in the form of a ring mounted on the toner container 35*a*. When the gear 38*b* is pressed into the jaw 35*a*4, the gear 38*b* is engaged with the engaging claw 35*a*5, so that the gasket 39 is compressed, and the gear 38*b* is prevented from moving along the rotational shaft.

Since the engaging portion is outside the toner container beyond the gasket 39, the toner in the container 35 is prevented from leaking to the engaging portion during the image formation, and the production of the coarse toner particles can be prevented beforehand.

In the structure shown in FIG. 24, the gasket 39 functions to feel two surfaces of the gear 38*b*, and therefore, the sealing property is high, thus assuredly preventing the toner leakage.

The process cartridge described above comprises an electrophotographic photosensitive member or the like as the image bearing member, and at least one process means. Therefore, the process cartridge may include, an image bearing member and charging means; an image bearing member and developing means; an image bearing member and cleaning means; an image bearing member and two or more of the process means.

More particularly, the process cartridge may contain charging means, developing means or cleaning means together with an electrophotographic photosensitive member. It may contain at least one of charging means, developing means and cleaning means and an electrophotographic photosensitive member. As another example, at least the developing means and the electrophotographic photosensitive member may be contained in the cartridge. The cartridge thus constituted is detachably mountable to the main assembly of the image forming apparatus.

(Another Embodiment of Image Forming Station)

As the developing method, known two component magnetic brush development, cascade development, touch-down development, cloud development or the like are usable.

The image bearing member on which the toner image is formed by the developing device 5 is not limited to the photosensitive drum of the first embodiment. For example, it may be a photoconductor such as amorphous silicon, amorphous selenium, zinc oxide, titanium oxide or organic photoconductor (OPC) or the like. The configuration of the photosensitive member may be a drum, a belt, or a sheet. Usually, drum or belt are widely used. In the case of drum type, it comprises an aluminum cylinder of aluminum alloy or the like and a photoconductor evaporated or applied thereon.

As for the structure of the charging means, a so-called charging method is used in the first embodiment, but another charging system is usable in which a tungsten wire is shielded with metal such as aluminum at three sides therearound, and the tungsten wire is supplied with a high voltage, and the positive or negative ions produced thereby are moved toward the surface of the photosensitive drum to uniformly charge the surface of the drum.

As for the charging means, in addition to the roller type described above, blade type (charging blade), pad type, block type, rod type, wire type or the like are usable.

As for the cleaning method for removing residual toner from the photosensitive drum, a blade, a fur brush, a magnetic brush or the like are usable.

In the first embodiment described in the foregoing, the exemplary image forming apparatus using the developing device 5 has been a copying machine. However, the present invention is applicable to another machine if toner is used to form an image, and more particularly it may be a laser beam printer, LED printer, facsimile machine or the like.

(Experiment-1)

Using the toner cartridge C of the first embodiment, a stirring member 15 of FIG. 5 is set in a toner replenishing container 12 of a cylindrical shape having an internal length of 322.5 mm and 55 mm. This is set in a developing device 5 of FIG. 2 after being filled with 380 g of one component toner, and the image forming test was carried out. The rotational speed of the stirring member 15 was 10.2 rpm. A 5.24% original of A4 size was used and image forming operations were continued in an intermitted durability test mode, while the amount of the toner in the developer chamber 5*a* and the toner amount in the container 12 were measured.

As for the toner amount in the developing device from the space in the developer chamber 5*a*, approx. 100 g is a proper amount. At the initial stage of the image formation, the developer chamber 5*a* is empty, and therefore, a great amount of the toner is supplied into the developer chamber 5*a* from the container 12, and therefore, the toner amount in the developer chamber 5*a* relatively quickly increases, but when 100 g is reached, the amount saturates and maintains at a constant level.

With the continued image forming operation, the toner amount in the container 12 decreases, but the amount of the toner in the developer chamber 5*a* is maintained at approx. 100 g. When the toner in the container 12 is used up, the amount of the toner in the developer chamber 5*a* starts to decrease. The toner amount detecting means in the developer chamber is set to operate when the amount of the toner in the developer chamber becomes 70 g or less, and when 70 g is reached, a display requesting the exchange of the container 12 is produced. Until this point, approx. 7000 sheets are subjected to the image forming operations.

As the amount of the toner in the developer chamber 5*a*, 70 g is sufficient to produce a good image even if the original is a solid black image original. Even if new toner is supplied by the exchange with the fresh toner cartridge C, reverse charge fog is not produced due to self contamination.

The remaining amount of the toner in the container 12 after the completion of the image forming operations has turned out to be as low as 3–5 g.

Similar tests are carried out using an A4 size 25% original, and the toner amount detecting means is operated when approx. 1500 sheets are processed. At this time, the remaining amount of the toner in the container 12 was 5–10 g.

The relation between the toner remaining amount and the contamination is such that it is dependent on the configuration of the container 12, particularly on the size of the toner discharge opening 12*a*. However, as described in the foregoing embodiment, when the opening 12*a* is as small as 7 mm, the toner hardly leaks or scatters during the disposal operation if the remaining amount is less than about 10 g.

(Experiment-2)

In Experiment-2, 380 g toner is filled in a toner container 12 having the same structure as in Experiment-1. The stirring member 15 is continuously rotated for 10 hours at a speed of 10.2 rpm without opening the toner discharge opening 12*a*.

The continuous rotation for 10 hours corresponds to 7000 process sheets. At this time, the required torque is measured. It decreases at an initial stage, and a constant level is maintained thereafter without increase.

After the rotation for 10 hours, the toner is taken out of the container 12, and filtered with 150 mesh (100 $\mu$m), and it has been confirmed that no coarse toner remains on the filter. The weight average particle size of the toner was 7.6 $\mu$m.

(Experiment-3)

Similar experiments are carried out with the toner replenishing container 12 of Embodiment 1 but with a conventional stirring member shown in FIG. 17. The stirring member 50 comprises a rotational shaft 51, a toner feeding blade 53 and an elastic supporting member 52 therebetween. A slide 54 extending in the radial direction is formed. The rotational radius of the toner feeding blade 53 has the same radius as the internal radius of the cylinder 55.

In the case of 4% original of A4 size, the toner amount detecting means operated after 6300 sheets are processed, and remaining amount of the toner in the toner replenishing container was 10–20 g.

In the case of 15% original of A4 size, 20–35 g of toner remains in the container. With this amount, the toner scatters when the container is inclined even slightly.

Then, the rotational speed of the stirring member was increased to 31.2 rpm. The remaining amount of the toner decreased, but a small amount of coarse toner (larger than 100 $\mu$m) remained on the filter in the experiments similar to the above-described Experiment-2.

As described in the foregoing, according to the present invention, the used-up cartridge is collected back, and the grip and cap are removed from the cartridge, and the toner discharge opening is shielded. Thereafter, the toner is supplied, and the cap and the grip are mounted. Thus, the toner cartridge can be reused. The stirring member or the like can be reused, thus accomplishing resource saving and energy saving.

In addition, upon the remanufacturing of the toner cartridge, the toner may be supplied through the toner discharge opening in the toner replenishing container without removing the grip or the cap, as a result the toner cartridge can be recycled more easily.

Upon the remanufacturing of the toner cartridge, the toner replenishing container is cleaned, or the torque required for rotating the stirring member is checked, so that the toner cartridge having the same performance as a fresh cartridge can be remanufactured.

While the invention has been described with reference to the structures disclosed herein, it is not confined to the details set forth and this application is intended to cover such modifications or changes as may come within the purposes of the improvements or the scope of the following claims.

What is claimed is:

1. A developer cartridge, comprising:

a cylindrical body for accommodating a developer;

a discharge opening, provided in a cylindrical portion of said cylindrical body, for permitting discharge of the developer;

a sealing member for sealing said discharge opening;

a receiving opening, provided in a longitudinal end of said cylindrical body, for receiving the developer in said cylindrical body;

a removable cap for capping said receiving opening;

a gripping member having a plate-like grip for mounting and dismounting said cartridge and covering said cap.

2. A cartridge according to claim 1, wherein said gripping member is provided with a prohibiting portion for prohibiting removal of said cap.

3. A cartridge according to claim 2, wherein said prohibiting portion is in contact with said cap.

4. A cartridge according to claim 3, wherein said prohibiting portion is in the form of a rib.

5. A cartridge according to claim 1, wherein said gripping member is mounted to said cylindrical body.

6. A cartridge according to claim 1, wherein said gripping member is provided with a locking portion for locking rotation of said cartridge.

7. A cartridge according to claim 6, wherein said locking portion has a lever and a locking projection.

8. A cartridge according to claim 6, wherein said gripping member is of polypropylene resin.

9. A cartridge according to claim 1, wherein said gripping member covers the entirety of said cap.

10. A developer cartridge remanufacturing method, wherein said cartridge comprises a cylindrical portion having an opening extending in a longitudinal direction, the cylindrical portion being provided with a hole at a longitudinal end, a cap for capping said hole and a gripping member for mounting and dismounting the cartridge and covering the cap, comprising the steps of:

removing the gripping member;

removing the cap;

sealing the opening;

supplying a developer through the hole;

capping the hole; and mounting the gripping member so as to cover the cap.

11. A method according to claim 10, wherein said cartridge comprises a stirring member for stirring the developer by rotation in said cylindrical portion, said method comprises a step of checking a torque required by rotation of said stirring member prior to said hole sealing step.

* * * * *

UNITED STATES PATENT AND TRADEMARK OFFICE

CERTIFICATE OF CORRECTION

PATENT NO. : 5,870,652

DATED : February 9, 1999

INVENTOR(S) : AKIHITO KANAMORI, ET AL.

It is certified that error appears in the above-identified patent and that said Letters Patent is hereby corrected as shown below:

COLUMN 1,
Line 52, ""steel" should read --stainless steel stirring member--.

COLUMN 2,
Line 66, "13(a)to" should read --13(a) to--.

COLUMN 3,
Line 7, "FIG." should read --FIGS.--;
Line 25, "FIG." should read --FIGS.--, "show" should be deleted, and "illustrates" should read --illustrate--;
Line 33, "embodiment" should read --embodiments--; and
Line 52, "transfer" should read --a transfer--.

COLUMN 4,
Line 16, "a top" should read --top--;
Line 34, "embodiment," should read --embodiment--;
Line 48, "described." should read --be described.--;
Line 60, "preferably," should read --preferably--;
Line 61, "the 5a" should read --the developer chamber 5a--; and
Line 63, "tendency" should read --a tendency--.

COLUMN 5,
Line 12, "inner" should read --and an inner--;
Line 19, "material, among" should read --material. Among--;

UNITED STATES PATENT AND TRADEMARK OFFICE

CERTIFICATE OF CORRECTION

PATENT NO. : 5,870,652

DATED : February 9, 1999

INVENTOR(S) : AKIHITO KANAMORI, ET AL.

It is certified that error appears in the above-identified patent and that said Letters Patent is hereby corrected as shown below:

COLUMN 5
Line 20, "resin, polyester" should read --resin and polyester--;
Line 23, "anti-impact" should read --high-impact--;
Line 24, "polystylene" should read --polystyrene--, and "Beside," should read --Beside--;
Line 41, "saved." should read --reduced.--;
Line 56, "preferably," should read --preferably--; and
Line 63, "high" should read --and high--.

COLUMN 6,
Line 10, "projection" should read --projections:projection--.

COLUMN 7,
Line 38, "One of the" should read --The--.

COLUMN 8,
Line 37, "in conveniences" should read --inconveniences--;
Line 53, "by" should be deleted;
Line 54, "which" should be deleted;
Line 66, "anti-impact" should read --high-impact--.

COLUMN 11,
Line 11, "polyetylene" should read --polyethylene--;
Line 12, "Particularly, the" should read --The--;

UNITED STATES PATENT AND TRADEMARK OFFICE

CERTIFICATE OF CORRECTION

PATENT NO. : 5,870,652

DATED : February 9, 1999

INVENTOR(S) : AKIHITO KANAMORI, ET AL.

It is certified that error appears in the above-identified patent and that said Letters Patent is hereby corrected as shown below:

COLUMN 11
Line 57, "If" should read --On the contrary, if--; and
Line 58, "on the contrary" should be deleted.

COLUMN 13,
Line 1, "closing and shutting" should read --closing--.

COLUMN 14,
Line 18, "scattering" should read --scatters--.

COLUMN 16,
Line 44, "provided" should read --provided at--; and
Line 45, "facing to" should read --facing--.

COLUMN 17,
Line 4, "projection" should read --locking projection--;
Line 5, "projection" should read --locking projection--;
Line 28, "member" should read --stirring member--; and
Line 60, "stirring rod 15b" should read --stirring blade 15b--.

COLUMN 18,
Line 48, "wearings" should read --clothing--.

COLUMN 20,
Line 18, after "developer device 5" insert --are increased--.

UNITED STATES PATENT AND TRADEMARK OFFICE

CERTIFICATE OF CORRECTION

PATENT NO. : 5,870,652

DATED : February 9, 1999

INVENTOR(S) : AKIHITO KANAMORI, ET AL.

It is certified that error appears in the above-identified patent and that said Letters Patent is hereby corrected as shown below:

COLUMN 21,
Line 5, "14 and 14" should read --13 and 14--.

COLUMN 23,
Line 47, "feel" should read --seal--.

COLUMN 24,
Line 44, "intermitted" should read --intermittent--.

COLUMN 26,
Line 1, "cap," should read --cap;--.

Signed and Sealed this

Fourth Day of January, 2000

*Attest:*

*Attesting Officer*

*Acting Commissioner of Patents and Trademarks*